US010184470B2

(12) United States Patent
Barnett, Jr.

(10) Patent No.: US 10,184,470 B2
(45) Date of Patent: Jan. 22, 2019

(54) SEGMENTED FLUID END

(71) Applicant: W. H. Barnett, Jr., Fort Worth, TX (US)

(72) Inventor: W. H. Barnett, Jr., Fort Worth, TX (US)

( * ) Notice: Subject to any disclaimer, the term of this patent is extended or adjusted under 35 U.S.C. 154(b) by 185 days.

(21) Appl. No.: 15/404,793

(22) Filed: Jan. 12, 2017

(65) Prior Publication Data

US 2017/0204852 A1 Jul. 20, 2017

Related U.S. Application Data

(60) Provisional application No. 62/279,293, filed on Jan. 15, 2016.

(51) Int. Cl.

| | |
|---|---|
| ***F04B 53/22*** | (2006.01) |
| ***F04B 53/00*** | (2006.01) |
| ***F04B 53/10*** | (2006.01) |
| ***F04B 19/22*** | (2006.01) |
| ***F04B 1/04*** | (2006.01) |
| ***F04B 1/053*** | (2006.01) |
| ***F04B 9/04*** | (2006.01) |
| ***F04B 47/00*** | (2006.01) |
| ***F04B 53/16*** | (2006.01) |

(52) U.S. Cl.

CPC ..... *F04B 53/22* (2013.01); *F04B 1/0452* (2013.01); *F04B 1/053* (2013.01); *F04B 9/045* (2013.01); *F04B 19/22* (2013.01); *F04B 47/00* (2013.01); *F04B 53/007* (2013.01); *F04B 53/10* (2013.01); *F04B 53/1032* (2013.01); *F04B 53/16* (2013.01)

(58) Field of Classification Search

CPC ..... F04B 53/22; F04B 19/22; F04B 47/00; F04B 53/007

See application file for complete search history.

(56) References Cited

U.S. PATENT DOCUMENTS 8,083,504 B2 * 12/2011 Williams ..... F04B 1/00 417/273
8,701,546 B2 * 4/2014 Pacht ..... F04B 1/0408 92/128
8,874,383 B2 * 10/2014 Gambier ..... F04B 49/065 340/572.1

(Continued)

*Primary Examiner* — Thomas E Lazo
(74) *Attorney, Agent, or Firm* — Decker, Jones P.C.; Brian K. Yost; Geoffrey A. Mantooth

(57) ABSTRACT

A segmented fluid end is provided, the fluid end comprising a plurality of fluid end segments, each comprising a plunger manifold, intake head, and pressure head. In preferred embodiments, the fluid end comprises three fluid end segments ("triplex") or five fluid end segments ("quint"). The plunger manifold comprises first and second mounting surfaces, each comprising a fluid opening. An intake head mounting flange is adapted to be removably coupled to the first mounting surface and a pressure head mounting flange is adapted to be removably coupled to the second mounting surface. The plunger manifold comprises a plunger mounting member comprising a plunger opening adapted to receive a plunger. The pressure heads are adapted for cooperative coupling to adjacent pressure heads, such that, when coupled, the pressure heads are in fluid communication with one another. Methods of replacing the fluid end segments, plunger manifolds, pressure heads, and intake heads are provided.

20 Claims, 29 Drawing Sheets

(56) References Cited

U.S. PATENT DOCUMENTS

| | | | | |
|---|---|---|---|---|
| 9,188,123 | B2 * | 11/2015 | Hubenschmidt | F04B 53/007 |
| 9,243,630 | B2 * | 1/2016 | Foote | F04B 53/14 |
| 9,341,179 | B2 * | 5/2016 | Ochoa | F04B 53/007 |
| 2013/0112074 | A1 * | 5/2013 | Small | F04B 1/0404 92/161 |

* cited by examiner 181
261
179
171
173
175
80
177
142
80
116
138
146
124
120
189
134
140
150
148
183
40
80
118
80
84
94
185
187
295
82
167
161
285
271
132
291
90
40
28
78
30
76
295
52
256
26
68
60
56
24
169
66
295
64
28
171
62
61
54
58
22
173
175
271
40
177
108

106
98
82
86
88
102
85
100
80

SEGMENTED FLUID END

1. FIELD OF THE INVENTION

This invention relates in general to fluid ends used in plunger type reciprocating pumps and, in particular, to a segmented fluid end.

2. BACKGROUND OF THE INVENTION

Hydraulic fracturing is the injection, under pressure, of water, sand, and/or other fluids within a well formation to induce fractures in a rock layer. Oil and gas drilling operators commonly use hydraulic fracturing, or "fracking" to release petroleum and natural gas well as other substances from the rock layer. The high pressure injection creates new channels in the rock which can increase the extraction rates and ultimate recovery of fossil fuels. A hydraulic fracturing pump or "frac pump" is used to pump water, sand, gravel, acids, proprietary liquids and concrete into the well formation. The solids pumped down the hole into the fractures keep the fractures from closing after the pressure is released. Operators generally attempt to pump as much volume as possible at or above the pressure necessary to frac the well.

Fracking gas or oil wells is very expensive and generally charged by the hour. Because the formation may be located thousands of feet below the earth's surface, the pressures generated and required by frac pumps are substantial, sometimes exceeding 20,000 pounds per square inch (psi). At peak times, a given frac pump may operate for more than eight consecutive hours (with drive engines running) at as much as 2800 revolutions per minute (rpm). With gear changes, the pump generally runs between a low of 60 rpm to a high of as much as 300 rpm.

A frac pump comprises two major components: a power frame and a fluid end. The power frame and fluid end are held together by a group of stay rods. The power frame is driven by high horsepower diesel engines, electric motors, or turbine engines. Internally, a frac pump increases pressure within a fluid cylinder by reciprocating a plunger longitudinally within the fluid end cylinder. Conventional high pressure, high volume frac pumps have either three or five cylinders. Other designs may have more or fewer cylinder counts.

The fluid ends of hydraulic or well stimulation pumps must produce enormous pressure and move a large volume of abrasive fluids that is high in solids content. Frac pumps were originally designed for intermittent service of six to eight hours per day. Today's pumps operate many more hours per day, and require much more maintenance than ever before.

A conventional fluid end comprises a block of steel comprising a plunger opening and compression area, intake and pressure vales with an intake path for supply of media to the plunger area and an exit path, internally connected to the compression chamber, for the pressurized fluid transfer. The vast majority of conventional frac pump fluid ends are "mono blocks". A mono block is machined from a single piece of material weighing approximately 4500-8000 lbs. Recently, segmented fluid ends have been introduced in which the block is divided into a number of pieces corresponding to the number of cylinders. For example, a three cylinder fluid end ("triplex") in such a conventional segmented fluid end comprises three segments and a five cylinder fluid end "quint" comprises five segments. Each segment of such segmented fluid ends comprises a single block of material. The design and maintenance of the conventional one piece segmented fluid end is virtually no different than the design or maintenance of the conventional mono block.

After extended periods of use all fluid ends, either mono block or one piece segmented head, become worn or cracked and have many hours of downtime due to the many pressure and intake valve changes through the life of the one piece construction of the fluid ends.

Maintenance demand of the mono block or solid block segmented head design produces a great deal of downtime. Loss of a single cylinder of the mono block or one piece segmented head requires a complete replacement at great financial cost. Maintenance and repair creates machine downtime and increases the overall cost of oil and gas production. In order to repair a conventional mono block fluid end, the fracking trailer must be transported to a repair facility and the entire fluid end (mono block or solid piece segmented fluid end) must be removed from the pump with overhead cranes or fork lifts, disassembled, repaired or replaced. No disassembly of the one piece segmented head assembly can be performed in the field. The entire assembly has to be removed, no different than the mono block, because of design and weight. Only valve changes, plunger and packing changes can be performed in the field. Even with conventional segmented fluid ends, repairing a failed segment requires disassembly of the entire fluid end assembly, removing the affected segment comprising the plunger, one piece segment, intake valve, pressure valve and rear access discharge cover. This rear cover gives the required access, of the mono block or one piece segmented fluid end, to the intake valve, seat, valve spring and can hold the intake valve spring retainer. The segmented head of the present disclosure does not have or require the use of the cover, spring retainer or access point for the installation or service of the intake head. With the existing segmented designs, the loss of the intake or pressure valve or a worn or cracked manifold area requires the replacement of the entire segment. Valve changes in existing segmented fluid ends are no different in terms of actual time or method of replacement, than in a mono block. Such repair activities are costly and time consuming.

Due to the long rebuild turnaround, operation under less than ideal conditions, and high maintenance costs, frac pump owners inevitably must "over-buy" fracking units (at a cost of millions of dollars per unit) to compensate for the number of pumps that are constantly out of service.

What is needed is a fluid end that can be easily and cost effectively manufactured, serviced, and maintained preferably in the field.

The present disclosure provides a segmented fluid end comprising interchangeable plunger portions, intake portions, and pressure head portions such that the fluid end may be easily manufactured, and be quickly, easily serviced, and repaired in the field or service center.

SUMMARY OF THE INVENTION

Referring to FIG. 1, there is shown a cross-sectional view of a prior art, hydraulic fracturing pump ("frac pump") assembly. In operation, the conventional frac pump increases pressure within a fluid end having a chamber by reciprocating a plunger longitudinally within the fluid end. This plunger action moves fluid through valves, in and out the fluid end.

The present invention in its various embodiments and aspects of such embodiments provides a segmented fluid end comprising interchangeable plunger manifolds, intake heads, and pressure heads such that the fluid end may be easily and economically manufactured, serviced, and repaired. The segmented fluid end of the present disclosure can be economically produced out of many different combinations of longer wearing materials than conventional mono block or segmented fluid ends can be manufactured from. Whether formed from stainless steel or other materials, the cost of material and the machining of the part is much more economical than the large mono block.

The segmented fluid end of the present disclosure comprises a plurality of fluid end segments, each comprising a plunger manifold, intake head, and pressure head. In preferred embodiments, the assembled fluid end comprises three fluid end segments ("triplex") or five fluid end segments ("quint"). However, the principles provided in the disclosure apply to fluid ends comprising virtually any number of fluid end segments.

The plunger manifold (sometimes referred to herein as "manifold") of the preferred embodiment comprises a plunger manifold mounting flange, clearance for stay rod fastener, and plunger manifold body. This is the heart of the segment. Everything bolts to the plunger manifold. The plunger manifold can be rotated 180 degrees with the intake and pressure head attached. It can be replaced without having to replace the undamaged pressure or intake heads. Since the side of the manifold that has been running the pressure head wears faster than the intake side, close monitoring of wear on the pressure side will indicate when to rotate the manifold to put the less worn intake side to the pressure head, thus increasing the overall life of the plunger manifold. This extension of life to the manifold cannot be duplicated in any conventional fluid end.

The plunger manifold mounting flange is a thickened portion comprising a generally rectangular face comprising stay rod openings, a ratcheting packing fastener pawl fastener opening, and a plunger chamber opening. Upper and lower plunger manifold stay rod style mounting flanges each comprise a front mounting flange support and alignment bar fastener opening adapted to receive a rear and front support bar fastener for attachment of a front support bar and rear support bar. The front and rear support bars assist in coupling fluid head segment assemblies together to form the fluid end. The support bars can be external, internal, or a combination of external and internal assemblies, and can be round, flat, or comprise other configurations. The stay rod openings allow the assembled segments to be attached to a power frame that utilizes stay rods for the attachment of the fluid end. The fluid end is attached by installing the four stay rod openings in the plunger manifold mounting flange over the exposed ends of the stay rods. A washer and fastener are then installed and torqued to a proper setting to assure rigid holding of the fluid end in place.

In some embodiments, the plunger manifold further comprises segmented head to adapter plate fastener openings in the mounting flange of the plunger manifold. In such embodiments, there are two plate fastener openings. Into these plate fastener openings, a segmented head attachment fastener may be inserted. These plate fastener openings are used to attach the plunger manifold to a segmented head stud mount to stay rod mount power frame adapter plate or spacer section attachment plate of a component power frame.

This is one of two ways shown for mounting the quick change stud style mounting. The second is adapting the spacer section of the component style power frame to accept the quick change stud style plunger manifold.

The presently presented stud style fluid end type mounting flange is installed into the modified mounting plate of the spacer section. Individual sections of the fluid end can be removed or the entire fluid end assembly without loosening all the sections that make up the power frame. Once the modified spacer section is fastened, the crankshaft housing and spacer section becomes independent of the fluid end for sealing the different sections together.

In some embodiments, the segmented head attachment fastener is a metal stud threaded on both ends. One end screws into the fastener opening of the mounting flange of the plunger manifold and the other passes through the modified mounting plate of the spacer section.

In some embodiments, the plunger manifold comprises an alignment pilot. The alignment pilot is positioned through segmented head stabilization and alignment mounting plate opening. In this position, as part of the mounting flange the alignment pilot aligns and holds center distance of the fluid end segment as machined into the attachment plate of the spacer section.

A spacer section segmented head attachment plate, part of a fabricated assembly, holds the segmented fluid end at proper distance for open air travel of the pony rod and plunger. This is a typical example used in the industry for this purpose and is usually called a spacer section. The spacer section is a fabricated unit. The spacer section segmented head attachment plate of the present embodiment permits the stud style aspect of the segmented fluid end assembly to the component style power frame. This simple way of fastening the segmented fluid end to the attachment plate also allows for removal of one segment of the fluid end assembly without complete disassembly of the fluid end. The two stud or bolt design is very fast in its on and off usage but also allows easy 180 degree rotation of the plunger manifold because of either a preference in head location or to extend the life of the plunger manifold due to uneven wear in side of the plunger manifold.

The spacer section segmented head attachment plate of the present embodiment also holds the pawl assembly of the ratchet style packing nut. Except for the attachment plate of the present embodiment, this spacer section is otherwise conventional. A spacer section pony rod seal plate seals against of oil leakage between the spacer section and the cross head section. The spacer section pony rod seal plate also offers a mounting place for a seal plate and seal to seal against the pony rod in its in and out operation. Spacer section support tubes and gussets hold, and maintain a proper distance between the seal plate and the attachment plate.

In some embodiments, the plunger manifold comprises access ports to the inside of the pressure chamber. These access points can be used for, example but not limited to, taking samples of frac fluid or monitoring the frac fluid pressure. The access points also can be used for injection of gasses or liquids. Plunger manifold access points can also be used to drain the manifold and inject oil for storage to prevent corrosion damage to the inside of the plunger manifold.

The ratcheting packing pawl fastener opening allows the attachment of a spring loaded ratcheting packing nut pawl that is utilized in a ratcheting packing nut that keeps the ratcheting packing nut in position and does not allow the ratcheting packing nut to come loose. The conventional packing nut is torqued against a shoulder holding the packing in a predetermined squeeze. There is no adjustment to the packing when it is positioned. Conventional packing nuts come loose frequently. In conventional systems, when the packing starts to leak it has to be replaced. With the ratcheting packing nut arrangement of the present invention, when the packing starts leaking, the user can tighten the ratcheting packing nut a tooth or two and get an extended life out of the packing that would normally be replaced at this time. This adjustment is very fast due to the design of the ratcheting action of the packing nut.

The plunger chamber opening comprises a circular cross section and is positioned in the approximate center of the plunger manifold flange face. The plunger manifold flange face positions the fluid end when mounted, either stay rod mount or stud mount, a proper distance from the power frame for stay rod mount or for component power frame mount. The fluid end can be attached to the power frame and sectional power frame in several ways, including, but not limited to, a stay rod mount or a stud mount. Both types of mounts have the same function and are designed to be used with conventional types of frac pump power frames on the market.

The entry to the plunger chamber contains the threads and shoulder that hold the packing nut and the packing gland. The size of the entry and bore for the plunger can be modified for the different diameter plungers required to do the job. The plunger chamber comprises a generally circular cross section and extends through the different types of plunger manifold mounting flanges and terminates at a plunger chamber back wall. The plunger chamber back wall can be modified to give better wear performance and longer life to the plunger manifold by either redirecting the flow or retarding flow against the rear of the plunger manifold.

When threaded into plunger chamber, ratcheting packing nut compresses plunger packing causing such packing to extend radially towards an axial center of plunger chamber. The ratcheting packing nut comprises a packing nut front face comprising ratcheting packing nut teeth structured and arranged to engage a ratcheting packing nut pawl. The ratcheting packing nut teeth are a one way gear type tooth designed to allow the ratcheting packing nut pawl to lock into place when the ratcheting packing nut loosens and allow the ratcheting packing nut pawl to slide over the top of the tooth when tightening the ratcheting packing nut. When the ratcheting packing nut is tightened within plunger chamber, the ratcheting packing nut pawl is raised upon each tightening turn by sloped teeth ridges and forced by the spring into a one way angled gear tooth such that the ratcheting packing nut is only permitted to turn in one direction when the ratcheting packing nut pawl is in position. The ratcheting packing nut pawl, thus, prevents the packing nut from turning in the opposite direction and from inadvertently loosening during pump operation.

Proximate to the plunger chamber back wall and transecting the plunger chamber is plunger manifold pressure chamber. The plunger manifold pressure chamber is the chamber that on the out stroke of the plunger is filled with frac fluid supplied from the intake valve and on the in stroke the frac fluid is forced out of the chamber through the pressure valve. Both pressure and intake valves are the same. All frac fluid being pumped under pressure goes through this plunger manifold pressure chamber.

Plunger manifold pressure chamber extends from a plunger manifold intake and pressure head mounting surfaces. Each surface can be 45 to 90 degrees from the front mounting surface. Both head mounting sides of the plunger manifold are the same, such that, for example, the intake head can use either side. The plunger manifold intake and pressure head mounting surfaces comprise flat mating surfaces to permit an inner face (face facing towards manifold when coupled to the manifold) of either a pressure head mounting flange or an intake head mounting flange to be secured tightly into the plunger manifold such to hold against the pressure being produced. Different types of sealing methods/devices can be utilized, including, but not limited to the use of a sealing gland, to keep the heads from leaking. The pressure head mounting flange locates and holds the pressure head to the plunger manifold. The intake head mounting flange locates and holds the intake head to the plunger manifold.

The intake head can be easily removed and replaced with a new or reworked intake head assembly. If the intake head has been damaged or is worn out it can be easily replaced. In the mono block style head when just one intake or pressure side of the head is worn out or cracked, in just one cylinder, the entire mono block style fluid end has to be replaced.

The intake head is easily separated and removed from the segmented fluid end assembly. Nothing, other than simple wrenches, need be used to remove the intake head and replace it with a new or reworked intake head. When reworking the intake head the valve, spring, valve seat and spring retainer can be replaced with all new parts or just the parts that are worn or broken. In the field, replacement of valves in the segmented intake head is one quarter or less the time that it takes to change valves in the mono block style head or single piece segmented head assembly.

The intake head of the preferred embodiment comprises the intake head mounting flange, an intake head intake manifold mounting flange, and an intake head valve holding body extending between the intake head mounting flange and intake head intake manifold mounting flanges. The intake head valve holding body retains the intake valve. The intake head intake manifold mounting flange holds the fastener openings that allow attachment of an intake manifold to the intake head. The intake manifold supplies frac fluid to the fluid end through this flange.

The intake head intake manifold mounting flange comprises a flat mating surface and a plurality of fastener openings threadedly adapted to receive fasteners such as bolts or studs so that a conventional intake manifold may be connected to the intake head. The intake head further comprises an intake pressure side of valve opening so that fluid may communicate from the inlet supply source to the plunger manifold pressure chamber through the intake head. When the plunger pulls out, the intake valve opens and frac fluid is pulled into the pressure chamber through this intake pressure side of valve opening. On the in stroke of the plunger the intake valve closes and the side of the valve sees full pressure of whatever pressure the pump is running.

The intake head mounting flange comprises a plurality of through fastener openings which permit the intake head to be coupled to the plunger manifold intake and pressure head mounting surfaces of the plunger manifold body.

In the preferred embodiment, only the intake head uses the valve spring retainer. The valve spring retainer is a very open design. It has a stronger design than the conventional design spring retainers. Conventional spring retainers are changed every time the springs are replaced. The new spring retainer will last for several valve changes. The intake valve spring retainer is pinched between the plunger manifold opening and the intake head. This makes it the easiest to install, remove, and be the most reliable spring retainer available. To keep the heads completely interchangeable, a spacer, of the same thickness as the intake spring retainer, is placed under the pressure head.

The intake head valve holding body is adapted to receive a conventional and commercially available intake valve assembly, for example, an intake valve assembly comprising a valve, valve spring and valve seat.

A valve spring retainer cap can be used that offers a replaceable mating surface between the valve spring and the valve spring retainer. The valve spring retainer cap offers a wear shield against the frac fluids between the mating points of the spring retainer and spring.

In the preferred embodiment, the intake chamber comprises an intake head frac fluid supply side of valve and a bottle bore. The intake head frac fluid supply side of valve is the opening in the intake head that frac fluid is supplied to the fluid end from the intake manifold. The bottle bore comprises an area that permits a deceleration area and clearance for the frac fluid to pass around the valve into the pressure chamber. The conventional bottle bore is one of the main reasons large expensive machinery must be used to machine the mono block fluid end or mono block style segmented head. The bottle bore configuration of the present invention brings down the overall cost of machining the head because of the easy access to the bore and much smaller size of the sections with standard inexpensive machinery.

Though the bottle bore comprises a conventional cross section, the modular design of the intake head permits the bottle bore to be machined with a conventional lathe due to size and easy access to the bores of the intake head. Thus, the bottle bore of the present invention may be formed more quickly and less expensively than the intake chamber of conventional mono block designs.

The pressure head can be easily removed and replaced. Due to the design of the seal retainers, in conjunction with seals, that seal the pressurized frac fluid paths from one pressure head to the next, the user can remove any center cylinders without removal and disassembly of the entire fluid end. All other conventional segmented heads assemblies have to be removed from the power frame, with heavy weight handling equipment, and disassembled to replace any of the sections of the one piece segmented head. The main reason is their sealing system between adjoining cylinders. The seal bushing spans between the respective discharge paths making the heads having to be pulled apart instead of being sheared apart as allowed in the preferred embodiment.

Replacement of the valve, valve seat and valve spring in the mono block fluid end or one piece segmented fluid end can interfere with each other requiring the user to pull one valve assembly to work on the other. In the preferred embodiment that extra labor and expense does not occur because the user works on the heads as separate entities. With the new design, the user unbolts the affected pressure or intake heads and bolts in either a new or rebuilt head and quickly puts the pump back into operation. The removed heads can then be rebuilt back at a service center. Replacement of the segmented pressure head is 300 to 600% faster than the time that it takes to change valves in the mono or one piece segmented style head.

The pressure side valve and pathways always wears out faster than the intake side. With the design of the segmented fluid end the user will get longer life out of the valve assemblies because the user can let the parts wear out, instead of adhering to some statistical predetermined maintenance schedule that forces the user to change both valves. When the parts wear out, they can be easily replaced.

The pressure head houses the pressure valve and has common attachment areas for exit of frac fluid, under pressure, to the pressure discharge outlets. The pressure head of the preferred embodiment is a one piece body comprising the pressure head mounting flange, a valve holding area, entry and exit paths for the frac fluids, recesses for seal retainers, a large access entry at the top for installation and removal of the pressure valve and a combination flow control wear sleeve, spring retainer, and a pressure head valve holding body extending between the discharge cover area and the pressure head mounting flange. The pressure head valve holding body houses the pressure valve assembly.

In the preferred embodiment, only the intake head comprises the valve spring retainer between the intake head and plunger body. To maintain a symmetry of the head mounting sides of the plunger manifold, the pressure head requires a valve spring retainer replacement spacer to make up for the space the intake valve spring retainer would have occupied.

The pressure head main body comprises forward and rearward sides, and right and left sides. The forward and rearward sides are identical to each other such that either side can be mounted facing forward or rearward. In the preferred embodiment, the pressure head main body right side comprises threaded openings that permit connecting one pressure head segmented head to the next. The left side has through holes for a fastener to pass through to.

The pressure head main body upper side is the side opposite the pressure head mounting flange. The pressure head main body upper side may be positioned upward or mounted downward on the plunger manifold. Mounting the intake head on top could possibly help the fluid end perform better by helping cut down on cavitation. The industry standard is that the pressure head is up. The reason almost all fluid ends have this surface up is to assist in valve changes. The methods and tooling used in changing the valves are not easily used in the upside down position. This new design does not rely on gravity to assist in maintenance. The mono block and one piece segmented fluid end designs cannot explore other benefits that may be gained by intakes being in the up position.

The pressure head right and left sides each comprise flat mating surfaces (faces), a pressure discharge outlet, and a plurality of fastener receiver openings for coupling one pressure head to an adjacent pressure head. There is no limit on the amount of heads that can be connected. This method of fastening the heads together does away with external bars and brace and allows the user to swap the head without disassembly of the entire fluid end.

The discharge connection adapter of the preferred embodiment permits the pressure head to be coupled to a conventional pressure outlet comprising a particular bolt pattern. The use of this discharge connection adapter for the discharge connection allows frac fluid to exit the outside face of each segmented fluid end assembly. The male and female seal plates in use with the discharge adapter plate permit the heads to be removed individually. It keeps the pressure head from having dedicated sides for sealing which allows the pressure head to be mounted left or right. Thus, the discharge connection adapter can be coupled to either the left side or right side of the pressure head. This adapter is what allows any style or any size conventional discharge connection to be used with the design.

The pressure head comprises a generally "t" shaped internally discharge chamber that has an internal pressurized fluid path extending from the plunger manifold pressure chamber into the pressure head and out the left and/or right pressure head pressure discharge outlets. This is the path that the frac fluid will follow to exit the fluid end assembly. The fluid can track in either direction or both directions at once. The direction depends on the setup at the fracking location.

The discharge chamber is further adapted to receive a conventional and commercially available discharge valve assembly, for example a discharge valve assembly comprising a valve, valve seat, and valve spring. The discharge chamber comprises a narrow inlet portion within the pressure head mounting flange, a mid-portion comprising a pressure head bottle bore within the pressure head valve holding body, and a narrow upper portion.

The large cavity above the bottle bore up to the discharge cover provides clearance to install and remove the pressure valve assembly. A directional control valve offers a proper flow direction for the frac fluid and a wear surface that will extend the life of the pressure head by offering the sleeve's surface to wear instead of the inside walls of the pressure head and will cut down on wear to the discharge cover. The directional control valve also takes the channeled fluid and directs the flow directly into the discharge paths. The replaceable wear surface greatly increases the life of the pressure head. The directional control valve also acts as the pressure valve spring retainer. The discharge path in the mono block and mono block style segmented fluid end cannot be channeled or directed due to design restraints.

A large socket discharge cover nut gives access to a discharge cover, pressure valve seat, valve, valve spring and intake valve seat in the mono block or one piece segment fluid end. A conventional fluid end has two retainer nuts per cylinder. The discharge retainer in back of the conventional fluid end gives access to the intake valve seat, valve, and valve spring and will have a spring retainer designed to hold the valve spring in place. In some designs the spring retainer is actually attached to the discharge cover under the discharge nut and the other style will have a groove machined into the area above the intake spring that will eventually wash out requiring replacement of the fluid end. All intake spring retainers are small and weak and fail frequently. Access through the top discharge retainer opening, in the conventional design is used to press in and remove the intake valve seat. This is the only access for this operation in the field—a hard and time consuming operation. The top discharge retainer opening also gives access to the pressure valve seat. This is also a hard and time consuming operation. The conventional discharge cover nut has an Allen wrench mating surface machined into the center through the retainer. This is a very time consuming process to machine this octagon shape with its sharp corners through the retainer. In conventional discharge retainer nuts, the ratio of Allen wrench size to nut diameter is improper. The wrench size is too small. When the conventional discharge cover retainer has been in operation for a while and has corroded in place, the retainer is loosened with a sledge hammer. The diameter of the wrench is too small and is very springy when hit with the sledge hammer and can kick back making it a dangerous operation to remove the retaining nut.

The discharge cover (combination flow control, wear surface, spring retainer and discharge cover) of the present invention is modified for the longer reach to the valve spring and use with the directional control valve. The discharge cover has seals that seal access to the valves in the pressure head from leaking frac fluids.

The design of the discharge retainer nut of the present invention increases the ratio of wrench to retainer diameter and is much easier to machine and much safer to use. A wrench opening is machined as an octagon shape groove machined in a continuous path at a depth the same as the width of the groove. This ratio may change due to the application. No center hole access is required because of other access locations designed into the plunger manifold. In the conventional designs liquids enter through the Allen wrench openings and rust the discharge retainer nut to their mating discharge covers together making them very hard to remove. With the discharge retainer nut of the present disclosure, there is no center access to the nut, thus, no oxidation between parts. Each segmented head only uses one discharge retainer nut. No rear access is required for intake valve assembly removal and placement.

The modular design of the pressure head permits the entire interior vertical portion, from the bottom of the pressure head to the top of the pressure head to be machined by turning the pressure head on a small CNC lathe. Also the outside surface of the pressure head that needs to be turned would be turned in the same operation. The entire intake head is machined in a CNC lathe only going to a small milling machine for the bolt pattern and flat sides to be machined. In conventional mono blocks, none of the valve bores, packing nut threads, packing bore, plunger bore, discharge nut bore in one plane and entry from the intake bore, including the bottle bores, through the entire fluid end to and including the discharge retainer nut threads out the top of the head can be machined in a lathe due to the large size, weight, and non-symmetrical configuration of the mono block. They are milled, not turned, on a large expensive boring mill which is very slow and time consuming. Thus, all bores in the pressure head, intake head and plunger manifold of the present invention may be machined more quickly and less expensively than any conventional mono block design.

The plunger manifold of the present disclosure may comprise a number of different inlet and outlet configurations. For example, the angle at which fluids enter the manifold can be ninety degrees or an angle less than ninety degrees. Such different angles can extend the wear life of the manifold due to easier fluid movement transition in and out of the manifold. In the preferred embodiment, the plunger manifold intake and pressure head mounting surfaces are angled upward and downward, respectively, at 18 degrees with respect to the longitudinal axis of the plunger. These angles can be changed to enhance the flow, for example, of concrete vs. water.

The plunger manifold of the present disclosure can be easily removed and replaced without having to completely disassemble the segmented flued end assembly. The plunger manifold of the present disclosure is completely reversible. With this structure and arrangement, each plunger manifold intake and pressure head mounting surface may be used as either the pressure side or the intake side. During use, the pressure side of the plunger manifold wears faster than the intake side. The reversible structure of the present plunger manifold permits the user after a certain period of use to turn the head 180 degrees to extend the life of the manifold. This ability to rotate the plunger manifold can up the life of the manifold up to 75% and cannot be duplicated in any other fluid end.

In some embodiments of the present invention, for example, the user may find it desirable to use a smaller plunger to generate more pressure or a larger plunger to move a larger volume of fluid. Usually two adjacent sized plungers can be used with different sized packing nuts in each fluid end. Plunger diameters have a wide range of sizes. If the user has a full range size of plungers available to stimulate wells with that means the user will have several different sized fluid ends available. There are two options available. One is to have a separate fracking unit available for each size fluid end, times the required amount fracking units to do the fracking job, or take the time to change all fluid ends needed when a size change of plunger is required whether using the mono block, one piece segmented head or the present invention. The advantage of the present invention is that the user has only to stock and change whatever size plunger manifold is required and only have to stock, maintain and service the same pressure head and intake head for all plunger sizes. Not only does this ability of the new invention bring down cost of not requiring the expense of multiple mono block, one piece fluid ends and complete frac units but also gives all the advantages of the present invention in life, servicing, stocking and overall cost of ownership will save oil and gas operators millions in equipment and production costs.

A method of replacing a valve seat, valve seat or valve spring, in a pump is provided, the method comprising the steps of: providing a segmented fluid end comprising interchangeable plunger manifolds, intake heads, and pressure heads; selecting a head comprising the valve seat, valve seat or valve spring; removing the selected head; providing a replacement head comprising a valve seat, valve seat and valve spring; replacing the selected head with the replacement head.

A method of replacing an intake head or pressure head in a pump is provided, the method comprising the steps of: providing a segmented fluid end comprising interchangeable plunger manifolds, intake heads, and pressure heads; selecting a head; removing the selected head; providing a replacement head; replacing the selected head with the replacement head.

A method of replacing a plunger manifold in a pump is provided, the method comprising the steps of: providing a segmented fluid end comprising one or more interchangeable plunger manifolds; selecting a plunger manifold; removing the selected plunger manifold; providing a replacement plunger manifold; replacing the plunger manifold with the replacement plunger manifold.

DETAILED DESCRIPTION OF THE INVENTION

The present invention in its various embodiments and aspects of such embodiments provides a segmented fluid end which may be easily manufactured, repaired, or replaced. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation.

1. DISCUSSION OF PRIOR ART

Figure 1:
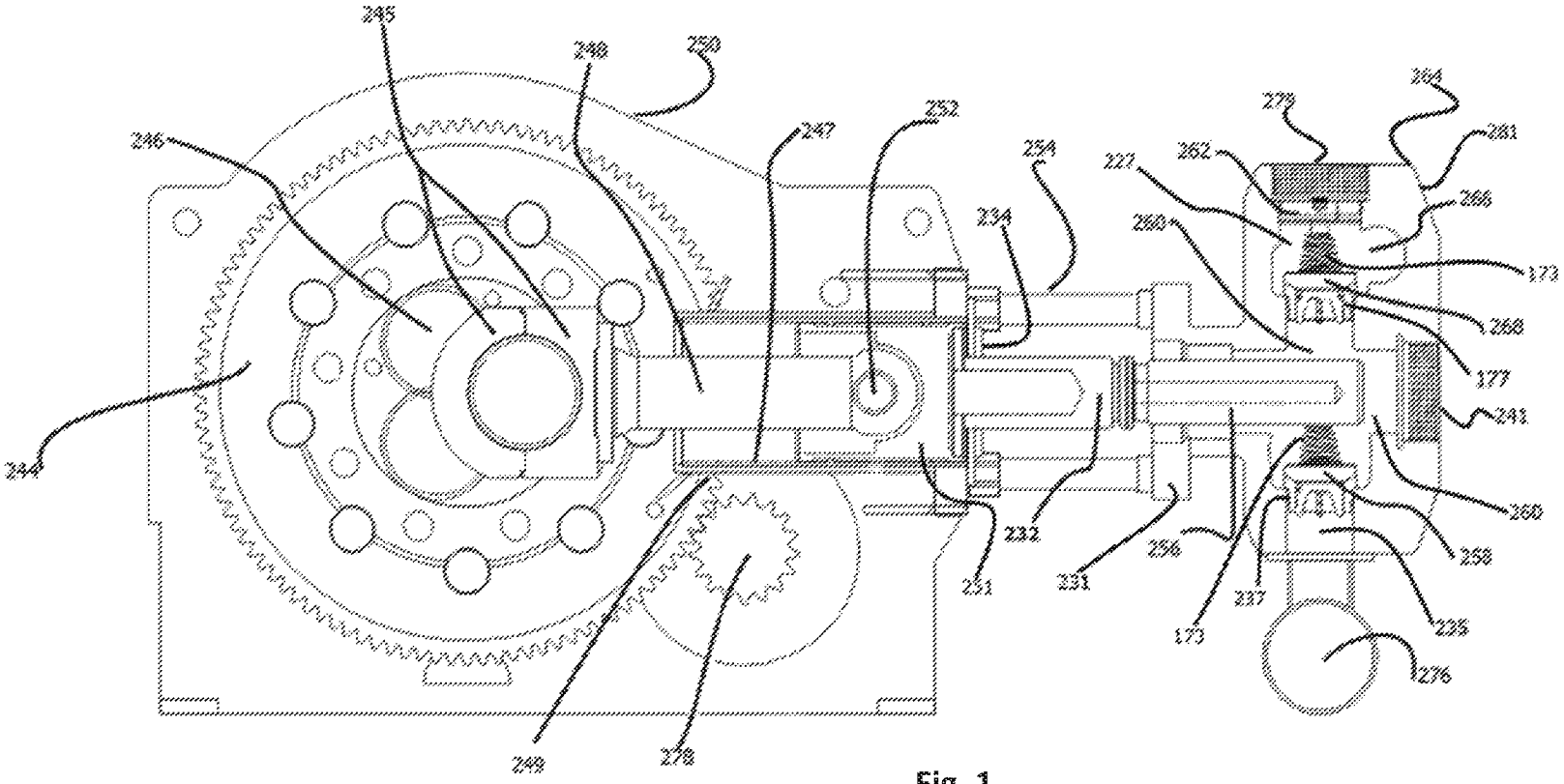
Fig. 1 Prior Art
FIG. 1 is a cross-sectional cut-away view of a prior art stay rod style hydraulic fracturing pump.
Figure 2:
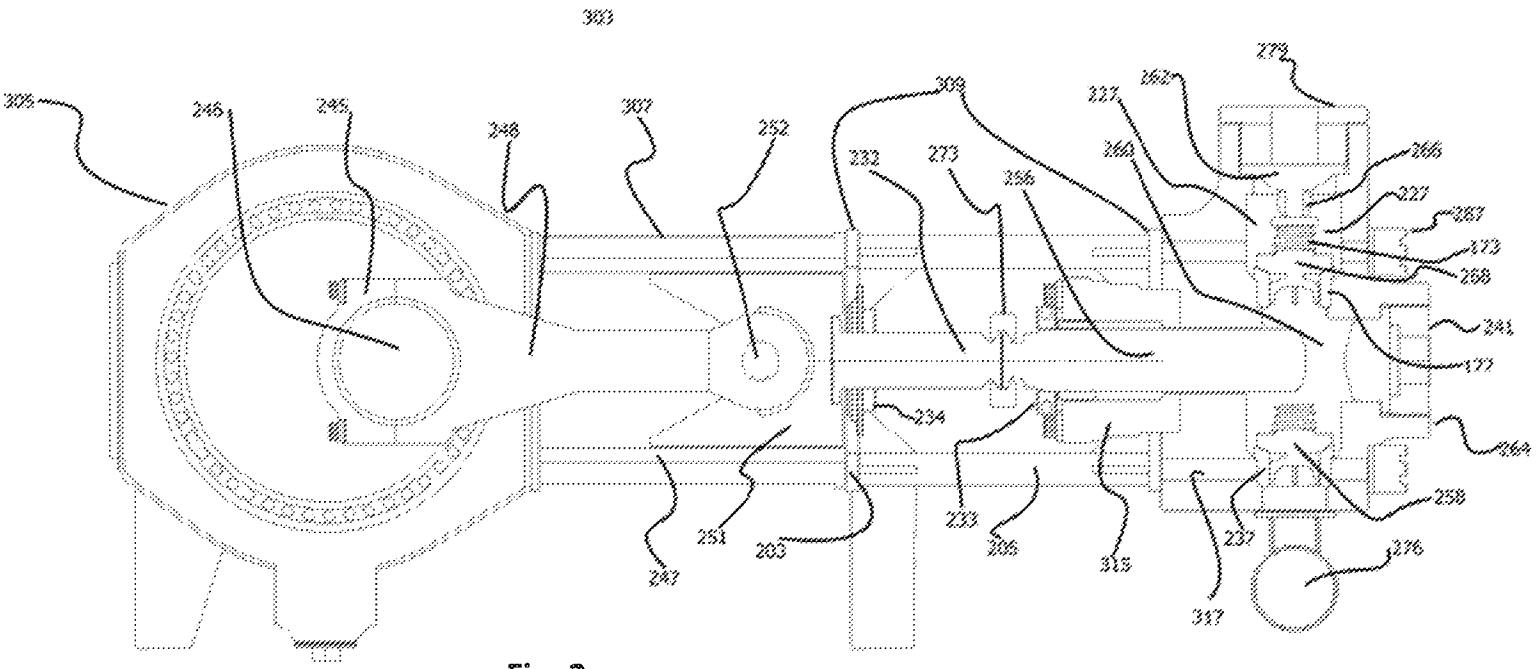
Fig. 2 Prior Art
FIG. 2 is a cross sectional cut away view of a prior art component style hydraulic fracturing pump.
Figure 3:
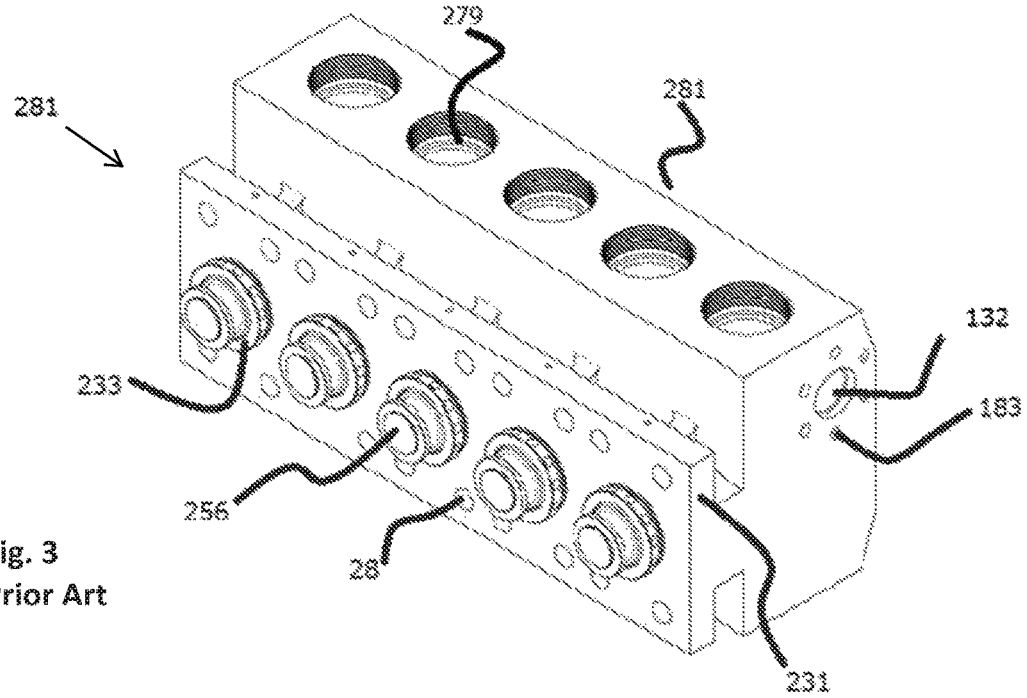
Fig. 3 Prior Art
FIG. 3 is an isometric view of a prior art stay rod style mono block fluid end assembled.

Referring to FIGS. 1 and 2 a stay rod style (FIG. 1) and component style (FIG. 2) prior art, hydraulic fracturing pump ("frac pump") assemblies are shown.

A power frame 250, 303 is a fabricated steel frame that supports all drive parts that change the rotational energy of the diesel engine 354 to useable linear energy required by a fluid end 264. A conventional fluid end 264 comprises a mono block fluid end 264 that can have three or five cylinders for pumping frac fluids. A traditional mono block fluid end 264 is manufactured from a solid billet of steel machined for three or five cylinders. This is the most common design fluid end 264 on the market.

In operation, the conventional frac pump 250, 303 increases pressure within the fluid end 264 having a compression chamber 260 by reciprocating a plunger 256 longitudinally within the fluid end 264 in a plunger compression area 260, a chamber that captures frac fluids delivered from a conventional frac fluid supply manifold 276 for compression.

The frac fluid supply manifold 276 is a fabricated tube assembly used to take pressurized frac fluid from the mixing tanks and give a common supply of fluid to each cylinder to be pressurized and sent down the well head to frac a well. The fluid is usually pressurized to maintain around 40 psi. This action is called supercharging the supply fluid to the suction side of the fluid end which helps cut down on cavitation during operation. Cavitation can destroy a fluid end.

The plunger 256 action moves fluid through valves 258, 268 in an out of the fluid end 264. An intake valve 258 opens on the suction stroke of the plunger 256 and closes on pressure stroke. Conventional pressure and intake valve springs 173, similar to automobile intake and exhaust valve springs, are available in cone and straight designs. Spring 173 rates are designed for the application. They are compression springs 173. The valve springs 173 assist in returning the valves 268 back into a closed position.

The conventional plunger 256 is a machined, hard coated, metal rod, offering different diameters that give different volumes of frac fluids. Plunger 256 travel is linear. Fluid is pulled into the fluid end 264 on the out stroke and is compressed and pushed out of the fluid end 264 on the in stroke.

Referring to FIGS. 1-7, a conventional fluid end 264 comprises a pressure chamber above valve area 227 and a fluid end discharge chamber 266. Both these areas 227, 266 are under pressure while in operation. The discharge path is common to the top and side of the pressure valve 268 and is common to all cylinders. The discharge path offers an exit on each side of the fluid end 264.

Figure 4:
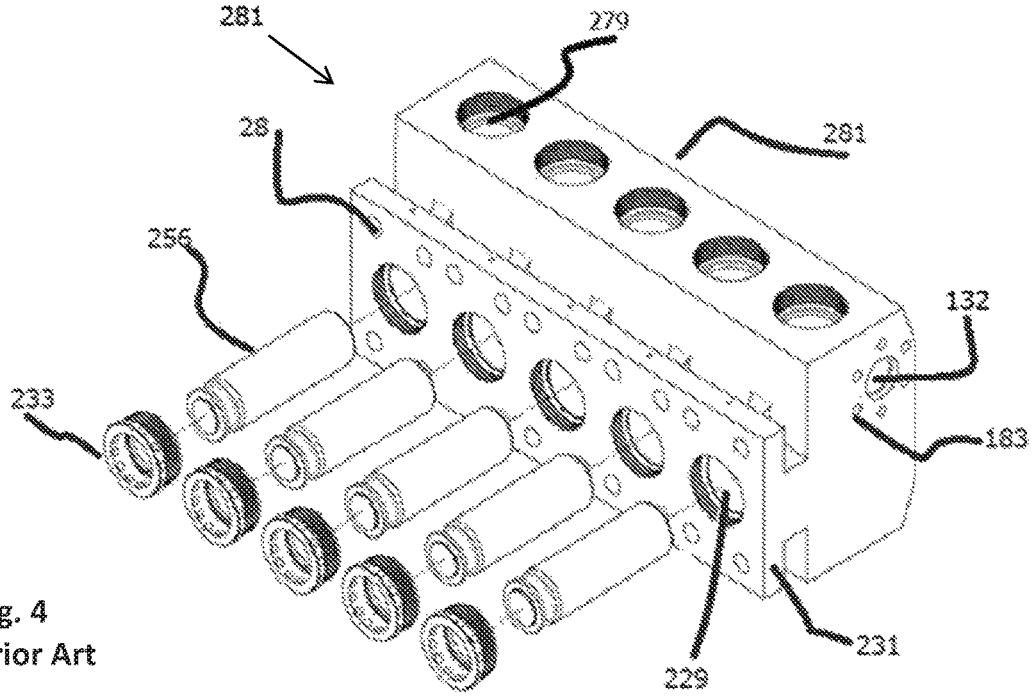
Fig. 4 Prior Art
FIG. 4 is an exploded view the prior mono block fluid end of FIG. 3.
Figure 5:
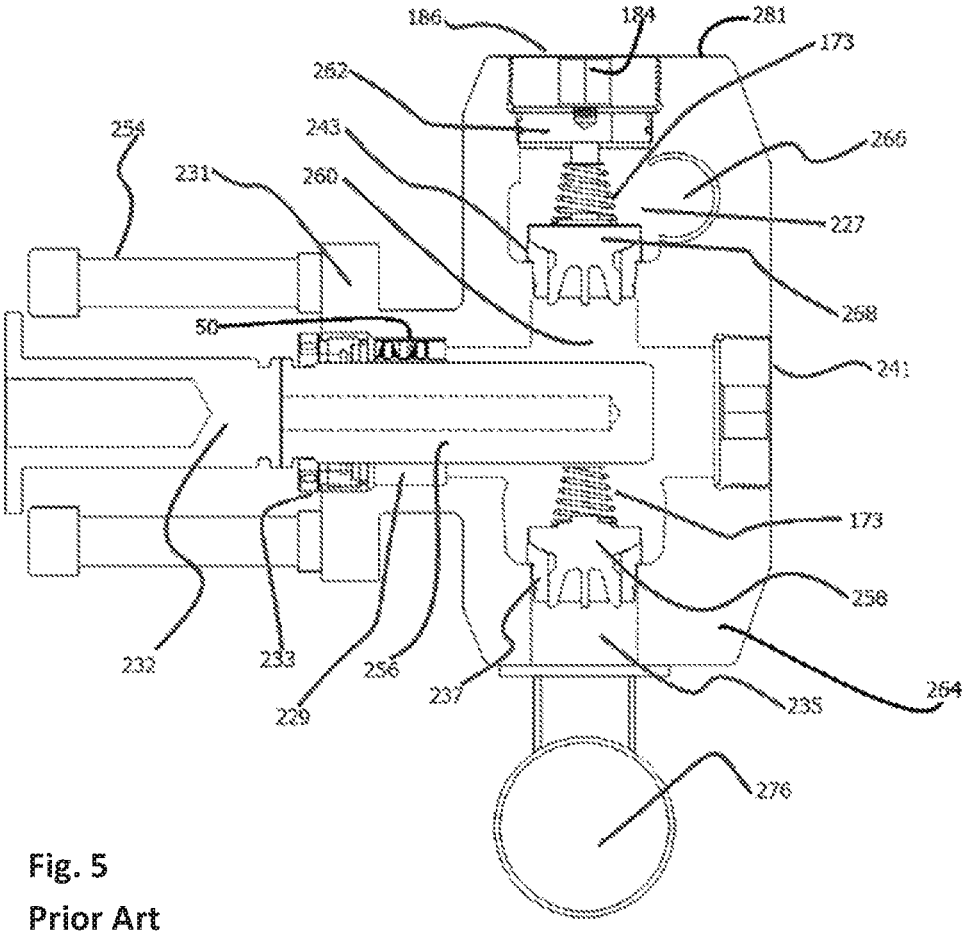
Fig. 5 Prior Art
FIG. 5 is a cross-sectional cut-away view of a prior art stay rod style mono block fluid end.

As the exit path of the frac fluid exposes one side of the valve 268 assembly to the pressurized flow of adjacent cylinders, the valve, valve seat and spring see aggravated wear on that side. This one sided wear shortens the life of the pressure valve and spring. This wear is dramatically more than the even-flow distributed around the intake valve. The life of the pressure side is at least 300% less than the intake side, both in manifold wear and the need for valve replacement. Referring to FIGS. 4 and 5, a conventional plunger packing gland 229 holds the packing seals 50 at a predetermined squeeze once the fixed position packing nut is tightened and torqued properly. The packing seals seal against the plunger 256 for leakage, during its travel on suction and pressure strokes.

A conventional stay rod style fluid end mounting flange 231 has four stay rods per cylinder that hold the fluid end 264 at proper distance and offer the support needed during operation. The largest manufactures offer this style mounting of the fluid end. Every change of fluid end 264, by replacement of a new fluid end 264 or reworked fluid end 264, requires removal of all stay rod nuts for removal of the fluid end 264, 331—twelve per triplex (three cylinder pump) or twenty for a quint (five cylinder pump). A conventional component style fluid end has eight nuts 287 for a triplex and twelve nuts for a quint that hold the fluid end to the spacer section 309. The spacer section gives a proper clearance area for the pony rod 232 and plunger 256 to work in during operation.

A conventional pony rod 232 transfer's energy from the power frame 250, 303 to the plungers 256 of the fluid end 264.

Figure 18:
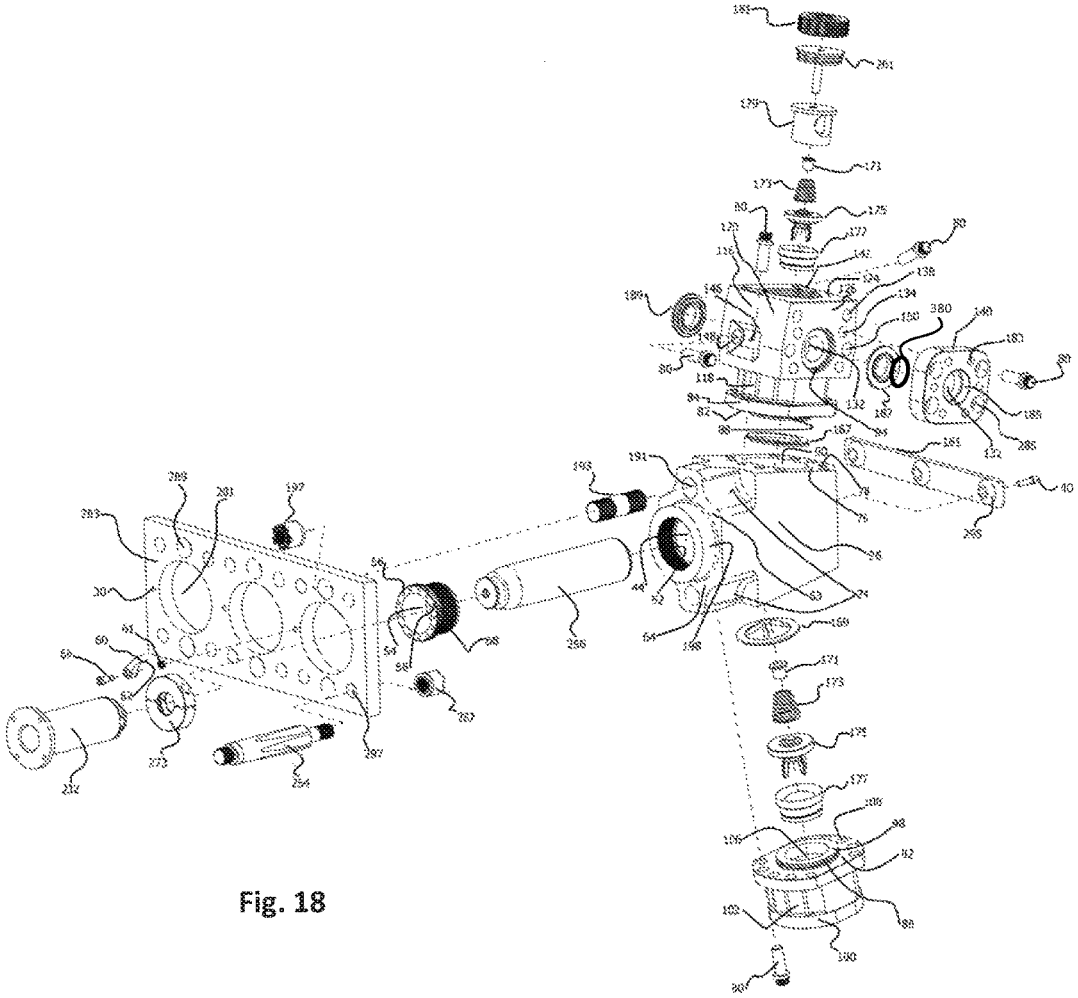
FIG. 18 is a front and side isometric exploded view of an angled head orientation individual assembly of a quick change stud style plunger manifold, an intake head, and a pressure head, in accordance with a preferred embodiment of the present invention. It shows adaptation of the stud style manifold to a stay rod style power frame with use of an adapter plate.
Figure 19:
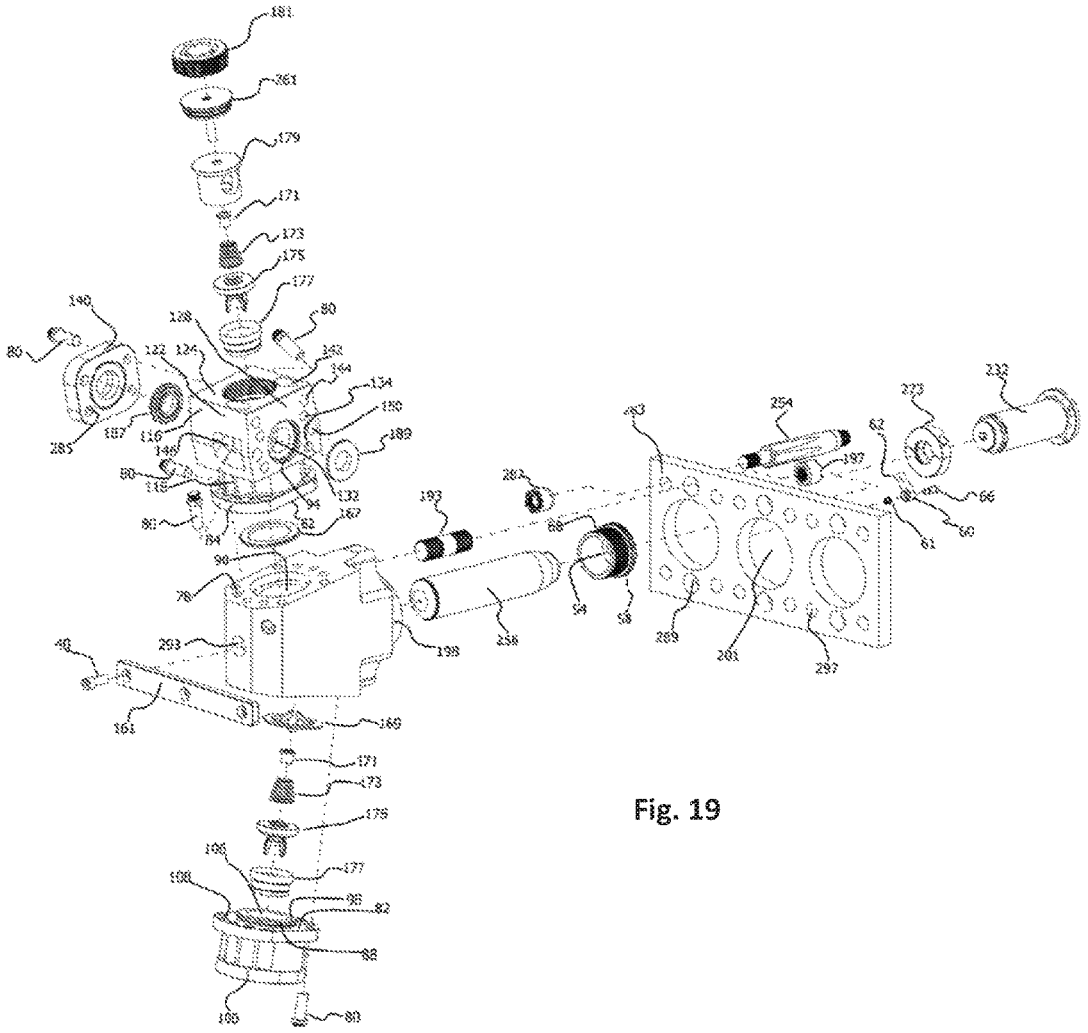
FIG. 19 is a rear and side isometric exploded view of an angled head orientation individual assembly of a quick change stud style plunger manifold, an intake head, and a pressure head, in accordance with a preferred embodiment of the present invention showing adaptation of the quick change stud style plunger manifold to a stay rod style power frame with use of an adapter plate.
Figure 20:
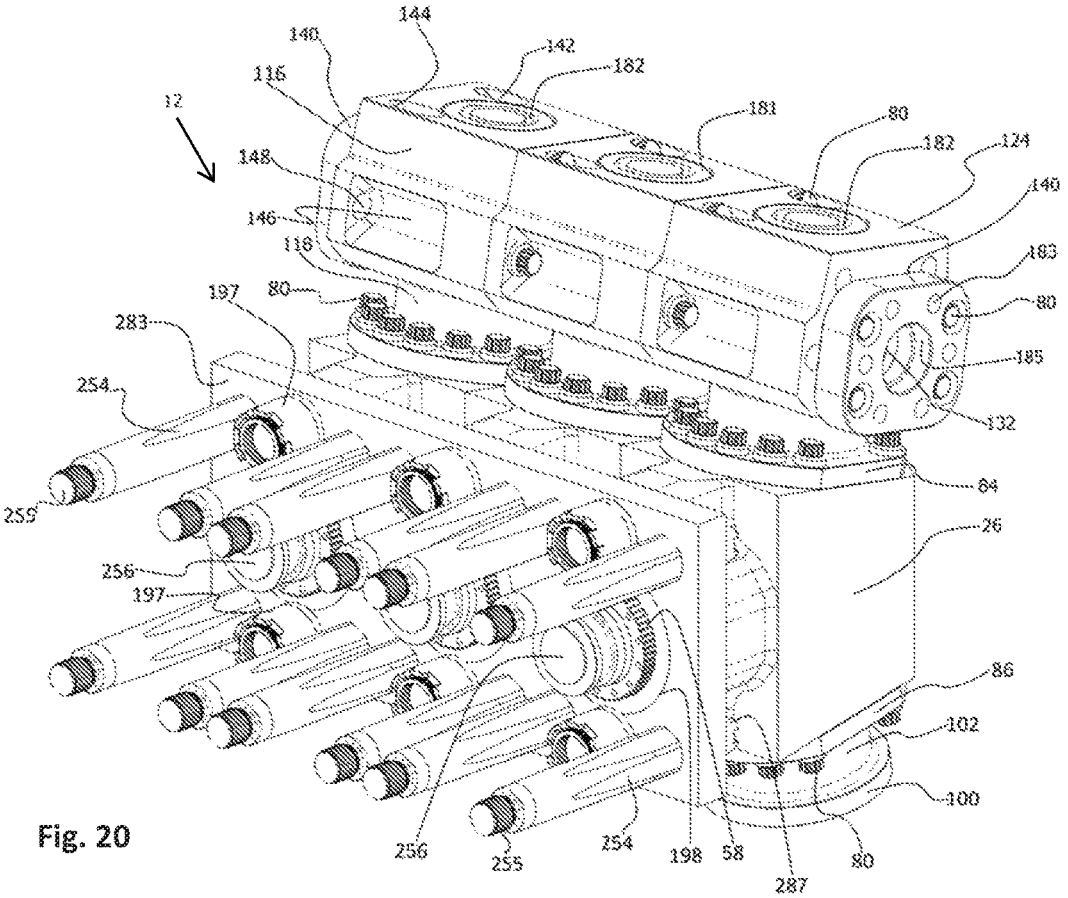
FIG. 20 is a front and side isometric view of an angled head orientation assembly of a quick change stud style plunger manifold, an intake head, and a pressure head, in accordance with a preferred embodiment of the present invention showing adaptation of the quick change stud style plunger manifold to a stay rod style power frame with use of an adapter plate.
Figure 21:
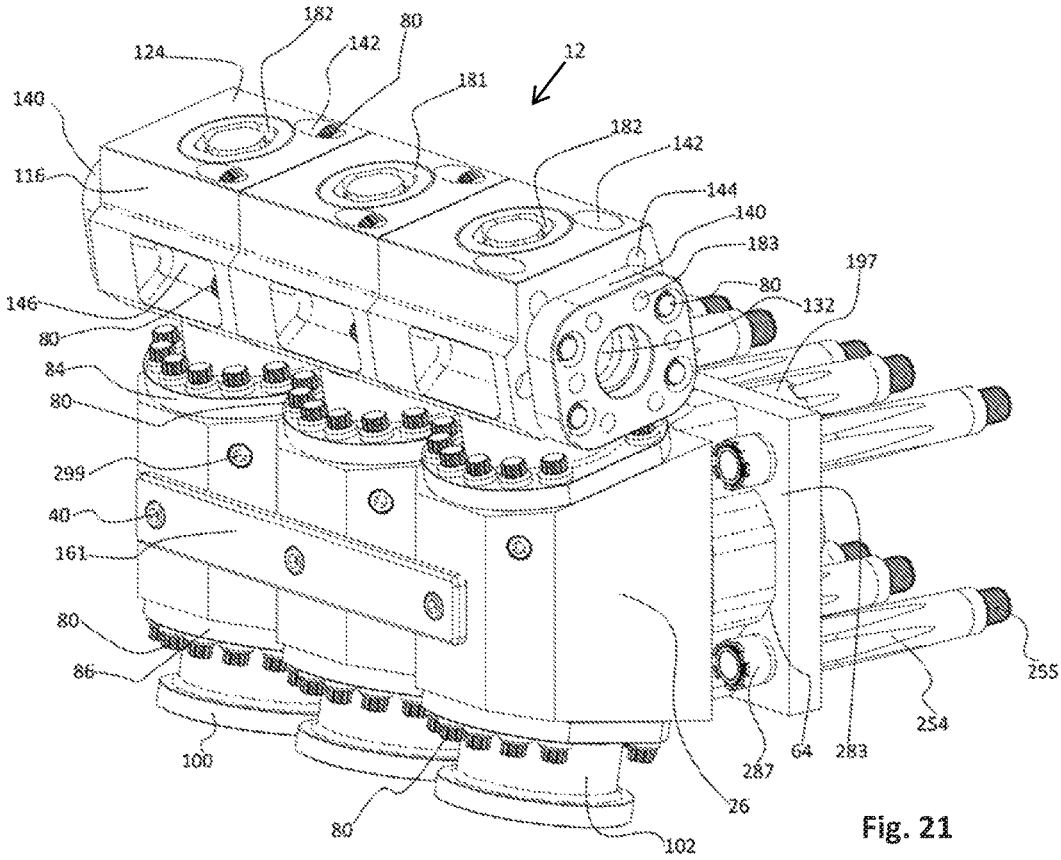
FIG. 21 is a rear and side isometric view of an angled head orientation assembly of a quick change stud style plunger manifold, an intake head, and a pressure head, in accordance with a preferred embodiment of the present invention showing adaptation of the quick change stud style plunger manifold to a stay rod style power frame with use of an adapter plate.

The pony rod 232 is typically clamped to the plunger 256, although there are other, less common, methods of coupling the pony rod 232 to the plunger 256. Referring to FIGS. 2, 18 and 19, a conventional two piece style clamp 273 that holds the pony rod to the plunger is shown. The outside diameter of the conventional pony rod 232 seal surface is polished for travel against the seal that keeps the oil from leaking from the power frame 250, 303 during pumping operations.

A conventional packing nut 233 positions and holds the packing, which seals against the plunger 256 operation, at a predetermined distance and is torqued to a setting that is supposed to hold position. There are different thread types used to hold against the pressure and the nut 233 in place. In actual performance the conventional packing nut 233 comes loose frequently.

A conventional intake frac fluid supply chamber 235 is the suction side of the intake valve. This side sees a charged frac fluid supply, usually around 100 psi, from the intake manifold to aid in the supply of frac fluid to the fluid end 264 on the suction stroke. This charged supply cuts down on cavitation. A conventional intake valve seat 237 has a tapered outside diameter that is pressed into place in the fluid end 264, 303. The intake valve seat 237 offers a mating surface for the valve to seal against pressure of the pumping action. The intake seat 237 and intake valve 258 only sees wear on the intake stroke. The face of the seat 237 and the inside diameter of the seat 237 are protected from pressure flows when the valve is closed. This is why the intake valve 258 and valve seat 237 and the manifold area above the valve see less wear than the manifold compression chamber discharge path to pressure valve and valve seat. The intake valve seat 237 can only be removed with tools through the top of the head.

Conventional intake valve springs 173, available in straight or tapered design, aid in closing of the valve and helps maintain valve position. Valve spring pressure is determined by diameter of the wire and the number of spirals. The number of spirals can limit travel of the valve 258, 268.

A conventional intake valve access discharge nut 241 seals the pressure chamber off and is installed from the back of the fluid end 264. When the discharge nut 241 is removed, the intake valve seat 237 can be placed into position to be pressed into place. The user also has access for removal of the intake valve seat after it is pressed out. When the discharge nut 241 is removed, the valve spring 173 can also be removed. The nut 241 can also have parts attached to hold the intake valve spring 173 into position. With the nut 241 removed, this is the only access for positioning and removal of intake valve 258, valve spring 173 and valve seat 237.

A conventional pressure valve seat 243 has a tapered outside diameter and is pressed into place in the fluid end 264. The seat 243 offers a mating surface for the valve to seal against pressure of the pumping action. The pressure valve seat 243, pressure valve 268 and valve spring 173 sees aggravated wear due to the high pressure forcing the abrasive contents of the frac fluids into the surfaces and high acceleration rate of the flow. The seat 243 can only be installed and removed through the top of the fluid end.

A conventional bull gear 244, a large ring with gear teeth driven by a drive pinion 278 connected to a crankshaft 246. The bull gear 244 transfers energy provided by fuel, such as diesel, through the power frame 250 to the fluid end 264. The drive pinion 278 is attached to a transmission, which supplies power, and is held in the power frame 250 with bearings. This design has two sets of teeth cut into it that line up and drive the bull gears 244.

Conventional connecting rod caps 245 are connected to connecting rods, capturing a bearing rotating on a crankshaft 246 journal. The conventional crankshaft 246 is a round shaft with journals and transfers energy from the bull gear 244 to connecting rods 248. The connecting rod 248, a rod with a flat end that bolts into the rod caps and the rounded end that pushes and wears against a bearing in the crosshead transfers the rotational energy of the crankshaft 246 to linear energy required for the pumping action.

A conventional brass sleeve 247, a replaceable sleeve, keeps the crosshead in a linear path and is supported by a conventional steel support sleeve 249.

A conventional wrist pin 252 is inserted through the crosshead and end of the connecting rod 248 and helps take the load off the crosshead due to all of the in and out action of the crosshead.

Conventional stay rods 254 are large rods that hold and support the fluid end 264, to a certain distance required by the stroke of the power frame 250, to the power frame 250. Conventional power frame attachment threads 255 attach the stay rods 254 to the power frame 250. A conventional attachment stay rod fastener 287 holds the mono block fluid end 264 into location.

Conventional studs 317 are long rods that hold and support the fluid end 264, in the component style power frame 303. The fluid end 264 is pressed against a spacer section 309 that holds the fluid end 264 a proper distance from the power frame 303. A conventional attachment stud fastener 287 holds the mono block fluid end 264 into location.

2. DISCUSSION OF PREFERRED EMBODIMENTS

Referring to FIGS. 9-28 there is shown a segmented fluid end 12 in accordance with preferred embodiments of the present invention. The present invention in its various embodiments and aspects of such embodiments provides a segmented fluid end 12 comprising interchangeable plunger manifolds 26, intake heads 85, and pressure heads 116 such that the fluid end 12 may be easily manufactured, serviced, and repaired.

The segmented fluid end 12 of the present disclosure comprises a plurality of fluid end segments 20, each comprising a plunger manifold 26, intake head 85, and pressure head 116. In preferred embodiments, the assembled segmented fluid end 12 comprises three fluid end segments 20 ("triplex") or five fluid end segments 20 ("quint"). However, the principles provided in the disclosure apply to fluid ends 12 comprising virtually any number of fluid end segments 20.

The plunger manifold 26 (sometimes referred to herein as "manifold 26") of the preferred embodiment comprises a plunger manifold mounting flange 22, clearance for stay rod fastener 24, and plunger manifold body 26. This is the heart of the segment. Everything bolts to the plunger manifold 26. The plunger manifold 26 can be rotated 180 degrees with the intake 85 and pressure head 116 attached. The plunger manifold 26 can be replaced without having to replace the undamaged pressure 116 or intake heads 85. Since the side of the manifold 26 that has been running the pressure head 116 wears faster than the intake 85 side, close monitoring of wear on the pressure 116 side will tell the user when to rotate the manifold 26 to put the less worn intake 85 side to the pressure head 116, thus increasing the overall life of the plunger manifold 26. This extension of life to the manifold 26 cannot be duplicated in any conventional fluid end.

Referring to FIGS. 9-13, 16-17, the plunger manifold mounting flange 22 is a thickened portion comprising a generally rectangular face comprising stay rod openings 28, a ratcheting packing fastener pawl fastener opening 30, and a plunger chamber opening 44. Upper and lower plunger manifold stay rod style mounting flange 22 each comprise a front mounting flange support and alignment bar fastener opening 291 adapted to receive a rear and front support bar fastener 40 for attachment of a front support bar 271 and rear support bar 161. The front mounting flange support and alignment bar fastener opening 291 is female and is cone shaped or v shaped with a threaded hole opening in the bottom. There is a matching male cone shape or v shape 295 of the support and alignment bar 161, 271. When the bar 161, 271 is attached, the two cone shapes or v shapes align with each other and seat out to each other when the fastener 40 is installed and torqued to a proper value. The placement of the front mounting flange support and alignment bar fastener openings 291 in the plunger manifold mounting flange 22 helps hold plunger manifolds 26 and pressure heads 116 at proper center distance and helps stabilize the fluid end segments 20 while in operation. There is one opening 291 in the upper and lower plunger manifold stay rod style mounting flange 22

Referring to FIGS. 9, 11, 13, 16, 27, a front mounting flange support and alignment bracket 271 comprises male self-alignment points 295 properly centered to fit into female recesses 291 in the front stay rod style mounting flange. These alignment points 295 can and will differ in spacing's due to the different center differences of the different pump makes and models. The bar 271 is made of a size and type of material strong enough to offer the strength required by the application. A fastener 40 holds the support and alignment bar male points 295 to the plunger manifold female parts. There are two bars 271, one on top of the front mounting flange and one under the front mounting flange which are mounted in alignment and stabilization front flange female openings 291. Each female opening 291 has a tapered shape and is threaded in the bottom. The female opening 291 is centered on the stay rod style mounting flange. The opening receives the front alignment bar 271 and helps stabilize and hold center distance from one fluid end segment 20 to the next. There are two openings 291, one on top and one on bottom of the mounting flange 22. Although the fluid end segments 20 of the present invention are joined to one another and stabilized in the manner shown, other ways of joining and stabilizing the fluid segments 20 may be used. For example, interior stabilizing members, other stabilizing devices, methods, and arrangements, as well as different coupling members, fasteners, methods, and arrangements, may be used without departing from the spirit and meaning of this disclosure.

A plunger manifold rear support and alignment bar 161 is mounted, with rear and front support bar fasteners 40, to the back of plunger manifold 26, spanning across to an adjacent plunger manifold 26. The plunger manifold rear support and alignment bar 161 comprises male self-alignment points 295 properly centered to fit into female recesses 293 in the plunger manifolds. These alignment points can and will differ in spacing's due to the different center differences of the different pump makes and models. The bar is made of a size and type of material strong enough to offer the strength required by the application. A fastener 40 holds the support and alignment bar 161 male points to the plunger manifold female parts.

Front and rear support bars 271, 161 assist in coupling fluid end segment assemblies 20 together to form the fluid end 12. The stay rod openings 28 allow the assembled segments 20 to be attached to a power frame 250 that utilizes stay rods for the attachment of the fluid end 12. The fluid end 12 is attached by installing the four stay rod openings 28 in the plunger manifold mounting flange 22 over the exposed ends of the stay rods. A washer and fastener are then installed and torqued to a proper setting to assure rigid holding of the fluid end 12 in place.

Referring to FIGS. 14, 18, 19, 20, 22-26, in some embodiments, the plunger manifold 26 further comprises segmented head to adapter plate fastener openings 191 in the mounting flange 198 of the plunger manifold 26. In such embodiments, there are two plate fastener openings 191. Into these plate fastener openings 191, a segmented head attachment fastener 193 may be inserted. These plate fastener openings 191 are used to attach the plunger manifold 26 to a segmented head stud mount to stay rod mount power frame adapter plate 283 or 199 spacer section attachment plate of a sectional power frame. This is a new mounting plate 283 that adapts the quick change stud style mounting flange of the segmented fluid end to the stay rod style mounting of the fluid end. This design will offer a true alternative to the stay rod style predominate in the industry for the last 60 years. Stud mount segmented head through openings 289 allow attachment of the stud style segmented head to the stay rod adapter plate 283. A conventional fastener is used to fix the fluid end 12 to the stay rod mounting plate 283. Adapter plate stay rod mount openings 297 are positioned through the stud mount segmented fluid end mounting plate 283 and accept the stay rod 254. There are four openings 297 per cylinder. Cylinder count is usually three and five.

This is one of two ways shown for mounting the quick change stud style mounting. The second is adapting the spacer section 309 of the component style power frame 303 to accept the quick change stud style plunger manifold 26.

The component power frame 303 is gaining in popularity in high horse power frame requirements.

In the conventional design, a long stud 317 bolts into the crankshaft housing 305. The crosshead section is installed over the studs 317, then spacer section 309, through the spacer section stud support pass through holes 275, and finally the mono block fluid end 264 is added to the studs 317 and fastener nuts 287 are installed to sandwich all the parts together. Referring to FIGS. 22-25, in the design of the present invention, the studs 193 are cut shorter and stop after the spacer section 200 where the fastener nuts 197 are applied. The presently presented stud style fluid end type mounting flange 63 is installed into the modified mounting plate 199 of the spacer section 309 and is held in place with fastener nuts 287. Individual sections 20 of the fluid end 12 can be removed or the entire fluid end assembly 12 without loosening all the sections 20 that make up the power frame 250. The user can change the heads with no loss of oil or damaging the large O rings that seal off each section 20. Each section of the sectional power frame is sealed off to each other with a large O ring. The only thing keeping the different sections from leaking oil is pressure from the tightened fasteners. When the fasteners are loosened, the sections separate, causing the large O rings to lose their seal. Oil then leaks out of the crosshead section where it connects to the crankshaft housing and spacer section. Once the modified spacer section is fastened, the crankshaft housing and spacer section becomes independent of the fluid end for sealing the different sections together. This saves a lot of labor with installation and removal of the quick change stud style segmented fluid end 12 over the more labor intensive mono block fluid end. This design also enhances safety and saves resources because there is no need to work with oily parts and no containment is needed to catch the oil loss when removing the fluid end.

In the embodiments shown in FIGS. 14, 18, 19, 22-26, the segmented head attachment fastener 193 is a metal stud threaded on both ends. One end screws into the fastener opening 191 of the mounting flange 63 of the plunger manifold 26 and the other passes through the modified mounting plate 199 of the spacer section 200. In the example shown, after the stud ends are passed through the plate fastener openings 190, a fastener nut 197 is tightened to a specific torque value, for whatever size stud is used, pinching the mounting plate in between the face of the mounting flange 64 and the nut 197. The fastener nut 197 is a conventional fastener available in many shapes, sizes, and materials.

In the embodiments shown in FIGS. 14, 18, 19, 22, & 26, the plunger manifold 26 comprises an alignment pilot 198. The alignment pilot 198 is positioned through segmented head stabilization and alignment mounting plate opening 201 (see e.g. FIGS. 18 and 19). In this position, as part of the mounting flange the alignment pilot 198 aligns and holds center distance of the fluid end segment 20 as machined into the attachment plate 199 of the spacer section 200. This area is designed as a slip fit, aiding in the quick change stud style aspect of this style mounting flange. The alignment pilot 198, being round, allows for easy installation or rotation of the plunger manifold 26.

Referring to FIGS. 22-25, a spacer section segmented head attachment plate 199, part of a fabricated assembly, holds the segmented fluid end 12 at proper distance for open air travel of the pony rod 232 and plunger 256. This is a typical example used in the industry for this purpose and is usually called a spacer section 309. The spacer section is a fabricated unit. The spacer section segmented head attachment plate 199 of the present embodiment permits the stud style aspect of the segmented fluid end assembly 12. This simple way of fastening the segmented fluid end 12 to the attachment plate 199 also allows for removal of one segment 20 of the fluid end assembly 12 without complete disassembly of the fluid end 12. The two stud or bolt design is very fast in its on and off usage but also allows easy 180 degree rotation of the plunger manifold 26 because of either a preference in head location or to extend the life of the plunger manifold 26 due to uneven wear in side of the plunger manifold 26. Having a pressure head 116 and intake head 85 preference location is not available in today's market. Designating such preferences would be a plus to helping stop cavitation due to the different weights and viscosities of the fluids being pumped. The spacer section segmented head attachment plate 199 of the present embodiment also holds the pawl assembly of the ratchet style packing nut. Except for the attachment plate 199 of the present embodiment, this spacer section is otherwise conventional. A spacer section pony rod seal plate 203 seals against of oil leakage between the spacer section 200 and the cross head section 307. The spacer section pony rod seal plate 203 also offers a mounting place for a seal plate 234 and seal to seal against the pony rod 232 in its in and out operation. Spacer section support tubes 205 and gussets 207 hold, and maintain a proper distance between the seal plate 203 and the attachment plate 199. The spacer section support tubes 205 and gussets 207 also offer a support and protective function to the mounting studs that sandwich the power frame 303, crosshead assembly section 307 and spacer section 200 together. The gussets 205 offer support and stabilization to the support tubes 205.

Referring to FIGS. 15, 17, 21, 25, in some embodiments, the plunger manifold 26 comprises access ports 299 to the inside of the pressure chamber. These access ports 299 can be used for, example but not limited to, taking samples of frac fluid or monitoring the frac fluid pressure. The access ports 299 also can be used for injection of gasses or liquids. Plunger manifold access points 299 can also be used to drain the manifold and inject oil for storage to prevent corrosion damage to the inside of the plunger manifold 26. More access ports 299 can be added. The access ports 299 can vary in shape and size and can be closed with various retainer arrangements.

The ratcheting packing pawl fastener opening 30 allows the attachment of a spring loaded ratcheting packing nut pawl 60 that is utilized in a ratcheting packing nut 54 that keeps the ratcheting packing nut 54 in position and does not allow the ratcheting packing nut 54 to come loose. The conventional packing nut is torqued against a shoulder holding the packing 50 in a predetermined squeeze. There is no adjustment to the packing 50 when it is in position. When the packing 50 starts to leak, it must be replaced. With the design of the present invention, when the packing 50 starts leaking, the user can tighten the ratcheting packing nut 54 a tooth or two and get an extended life out of the packing 50 that would normally be replaced at this time. This adjustment is very fast due to the design of the ratcheting action of the packing nut 54. This tightening can be repeated till the adjustment does not stop the leakage, thus, giving a longer running time and more value out of each packing material. This ratcheting packing pawl fastener opening 30 also can be installed into any existing mono block fluid end or existing segmented fluid end and bring the same benefit. The conventional packing nut cannot be adjusted and frequently comes loose. The ratcheting packing nut 54 is a good addition to any fluid end.

The plunger chamber opening 44 comprises a circular cross section and is positioned in the approximate center of the plunger manifold flange face 64. The plunger manifold flange face 64 positions the fluid end 12 when mounted, whether stay rod mount or stud mount, a proper distance from the power frame 250 for stay rod mount or 303 for sectional power frame mount. The fluid end 12 can be attached to the power frame 250 and sectional power frame 303 in several ways, including, but not limited to, a stay rod mount 250 or a stud mount 303. Both types of mounts have the same function and are designed to be used with conventional types of frac pump power frames 250, 303 on the market. The segmented heads mounts will be easily modified for future new power frame designs.

The entry to the plunger chamber 44 contains the threads and shoulder that hold the packing nut and plunger packing bore 48. The size of the entry and bore for the plunger 256 can be modified for the different diameter plungers required to do the job. The plunger chamber 44 comprises a generally circular cross section and extends through the different types of plunger manifold mounting flanges 22 and terminates at a plunger chamber back wall 46. The plunger chamber back wall 46 can be modified to give better wear performance and longer life to the plunger manifold 26 by either redirecting the flow or retarding flow against the rear of the plunger manifold. This cannot be performed in any other fluid end design.

The plunger packing bore 48 is a widened portion of the plunger chamber 44 adapted to frictionally engage conventional plunger packing 50. This plunger packing bore 48 holds the packing 50 that seals the manifold 26 to the plunger 256. This packing 50 stops leakage of frac fluids from around the plunger 256 during high pressure operation. The packing bore 48 is cut to close tolerances because the packing 50 cannot be adjusted in conventional fluid ends. The packing bore 48 is sized to hold the packing at a predetermined fixed length when the packing nut 54 is tightened and torqued properly.

The plunger chamber 44 comprises plunger chamber packing nut retaining threads 52 at the entry and is sized for whatever diameter conventional plunger 256 is required. Plunger chamber packing nut retaining threads 52 are adapted to receive threads 68 of a cooperatively threaded packing nut 54. These threads 52, 68 hold the packing nut 54 in place and allow adjustment of the packing material 50. The threads 52, 68 can be cut to several different thread designs. The threads 52, 68 have to be strong enough to handle heavy loads, for example, as high as 23,000 psi in the compression chamber.

When threaded into plunger chamber 44, ratcheting packing nut 54 compresses plunger packing 50 causing such packing 50 to extend radially towards an axial center of plunger chamber 44. When so compressed and when the plunger 256 is inserted within the plunger chamber 44, the packing 50 frictionally engages the plunger 256 and seals the plunging chamber 44 such that fluid cannot escape through the packing nut 54 when the pump is in operation.

The ratcheting packing nut 54 comprises a packing nut front face 56 comprising ratcheting packing nut teeth 58 structured and arranged to engage a ratcheting packing nut pawl 60. The ratcheting packing nut teeth 58 are a one way gear type tooth designed to allow the ratcheting packing nut pawl 60 to lock into place when the ratcheting packing nut 54 loosens and allow the ratcheting packing nut pawl 60 to slide over the top of the tooth 58 when tightening the ratcheting packing nut 54. These packing nut front face openings 56 are for wrench access to either tighten or loosen the ratcheting packing nut 54.

The ratcheting packing nut pawl 60 comprises a curved elongated length of material comprising an engagement portion 62 (finger) adapted to engage the ratcheting packing nut teeth 58. The ratcheting packing nut pawl 60 comprises an inner or outer spring which forces the ratcheting packing nut pawl 60 towards and into the packing nut teeth 58. The ratcheting packing nut pawl 60 is coupled to the plunger manifold flange face 64 via a ratcheting packing nut pawl fastener 66. When the ratcheting packing nut 54 is tightened within plunger chamber 44, the ratcheting packing nut pawl 60 is raised upon each tightening turn by sloped teeth ridges 68 and forced by the spring 61 into a one way angled gear tooth 58 such that the ratcheting packing nut 54 is only permitted to turn in one direction when the ratcheting packing nut pawl 60 is in position. The ratcheting packing nut pawl 60, thus, prevents the packing nut 54 from turning in the opposite direction and from inadvertently loosening during pump operation.

Thus, the ratcheting packing nut pawl 60 is spring loaded by a ratcheting packing nut pawl retention spring 61. The ratcheting packing nut pawl retention spring 61 holds tension against the ratcheting packing nut pawl 60 to keep the ratcheting packing nut pawl 60 locked into the tooth 58 of the packing nut 54. The spring 61 can be either internal or external. The function would be virtually the same.

The finger 62 of the ratcheting packing nut pawl 60 that engages the ratcheting packing nut teeth 58 is designed to lock into the tooth 58 of the ratcheting packing nut 54 when the ratcheting packing nut 54 tries to loosen and to slide over the tooth 58 when the ratcheting packing nut 54 is tightened. The ratcheting packing nut pawl 60 is pushed out of the way or removed when the ratcheting packing nut 54 needs to be removed.

The main function of the ratcheting packing nut 54 is to keep the ratcheting packing nut 54 from backing off and coming loose. The ratcheting packing nut 54 also offers easy adjusting of the packing 50 not only when the packing 50 is new but also when the used packing starts to leak the user can tighten the ratcheting packing nut 54 to squeeze the packing 50 tighter to stop the leak. The spring loaded pawl makes the ratcheting packing nut 54 hold position. Conventional packing nuts come loose frequently. When the conventional packing nut comes loose, the pump has to be shut down and the nut retightened. This ratcheting packing nut 54 simply cannot come loose. As the user tightens the ratcheting packing nut 54 a spring loaded pawl clicks into a gear tooth type outer radius of the ratcheting packing nut 54.

Proximate to the plunger chamber back wall 46 and transecting the plunger chamber 44 is plunger manifold pressure chamber 72. The plunger manifold pressure chamber 72 is the chamber 72, that on the out stroke of the plunger 256, is filled with frac fluid supplied from the intake valve 175 and on the in stroke the frac fluid is forced out of the chamber 72 through the pressure valve 175. Both pressure and intake valves 175 are the same. All frac fluid being pumped under pressure goes through this plunger manifold pressure chamber 72.

Plunger manifold pressure chamber 72 extends from a plunger manifold intake and pressure head mounting surfaces 76. Each surface 76 can be 45 to 90 degrees from the front mounting surface. Both sides of the plunger manifold 26 are the same, such that, for example, the intake head 85 can use either side.

The plunger manifold intake and pressure head mounting surfaces 85 each comprise a plurality of pressure head and intake head to plunger manifold fastener openings 78 and pressure head and intake head openings 90. These openings 90 allow access to the plunger area for supplying and discharging frac fluids in the plunger manifold 26.

The pressure head and intake head to plunger manifold fastener openings 78 are adapted to receive fastener bolts 80 or studs 80. In the preferred embodiment, the plunger manifold intake and pressure head mounting surfaces 75 each comprise twelve fastener openings 108 adapted to receive twelve fasteners 80. The plunger manifold intake and pressure head mounting surfaces 76 comprise flat mating surfaces to permit an inner face 82 (face facing towards manifold 26 when coupled to the manifold 26) of either a pressure head mounting flange 84 or an intake head mounting flange 86 to be secured tightly into the plunger manifold such to hold against the pressure being produced. The sealing gland 88 is what keeps the heads from leaking. There are many other ways of sealing the two heads 116, 85 to the manifold 26, pressure sleeves, gaskets, etc. The pressure head mounting flange 84 locates and holds the pressure head 116 to the plunger manifold 26. The intake head mounting flange 86 locates and holds the intake head 85 to the plunger manifold 26.

The intake head mounting flange 86 and pressure head mounting flange 84 each comprise flat mating surfaces 82 and an inner ring 98 comprising an intake and pressure head seal gland 88. This inner ring 98 can be built into the forging as shown or be a separate ring with seal glands that could be inserted between the heads 85, 116 and manifold 26. Several types of sealing methods could be used. Each inner ring 98 extends away from the respective flange 84, 86. The respective inner rings 98 and respective intake and pressure head seal glands 88 are adapted to be inserted into the respective pressure head and intake head openings 90. Thus, for example, when the pressure head 116 is coupled to the head mounts 76, the pressure head and intake head seal gland 88 is pressed against the corresponding fluid chamber recessed ledge 94. This action holds a seal to keep the intake 85 and pressure head 116 from leaking frac fluids from between the heads 85, 116 and the plunger manifold 26.

The intake head 85 can be easily removed and replaced with a new or reworked intake head assembly. If the intake head 85 has been damaged or is worn out it can be easily replaced in the field—a very good cost savings. In the mono block style head when just one intake or pressure side of the head is worn out or cracked, in just one cylinder, the entire mono block style fluid end has to be replaced.

The intake head 85 is easily separated and removed from the segmented fluid end 12 assembly. Nothing but simple wrenches can be used to remove the intake head 85 and replace it with a new or reworked intake head 85. When reworking the intake head 85 the valve, spring, valve seat and spring retainer can be replaced with all new parts or just the parts that are worn or broken. Replacing a worn valve in conventional fluid ends is a very time consuming process. In the field replacement of valves in the segmented intake head 85 is one quarter or less the time that it takes to change valves in the mono block style head 281 or single piece segmented head assembly 331. In a mono block style head 281 or single piece segmented head assembly 331 the pressure valve has to be removed to give the valve seat puller access to the intake valve seat.

The intake head 85 of the preferred embodiment comprises the intake head mounting flange 86, an intake head intake manifold mounting flange 100, and an intake head valve holding body 102 extending between the intake head mounting flange 86 and intake head intake manifold mounting flanges 100. The intake head valve holding body 102 retains the intake valve. The intake head intake manifold mounting flange 100 holds the fastener openings that allow attachment of an intake manifold 276 to the intake head 85. The intake manifold 276 supplies frac fluid to the fluid end 12 through this flange 100.

The intake head intake manifold mounting flange 100 comprises a flat mating surface and a plurality of fastener openings 104 threadedly adapted to receive fasteners 40 such as bolts 40 or studs 40 so that a conventional intake manifold 276 may be connected to the intake head 85. The intake head 85 further comprises an intake pressure side of valve opening 106 so that fluid may communicate from the inlet supply source to the plunger manifold pressure chamber 72 through the intake head 85. When the plunger 256 pulls out, the intake valve opens and frac fluid is pulled into the pressure chamber through this intake pressure side of valve opening 106. On the in stroke of the plunger 256 the intake valve closes and the side 106 of the valve sees full pressure of whatever pressure the pump is running.

The intake head mounting flange 86 comprises a plurality of through fastener openings 108 which permit the intake head 85 to be coupled to the plunger manifold intake and pressure head mounting surfaces 76 of the plunger manifold body 26. In the preferred embodiment, there are twelve 1¼ inch bolts 80 for the triplex and ten 1¼ inch bolts for the quint coupling the intake head 85 to the plunger manifold 26. Depending on pressure, this number and size of fasteners 80 will vary.

Figure 22:
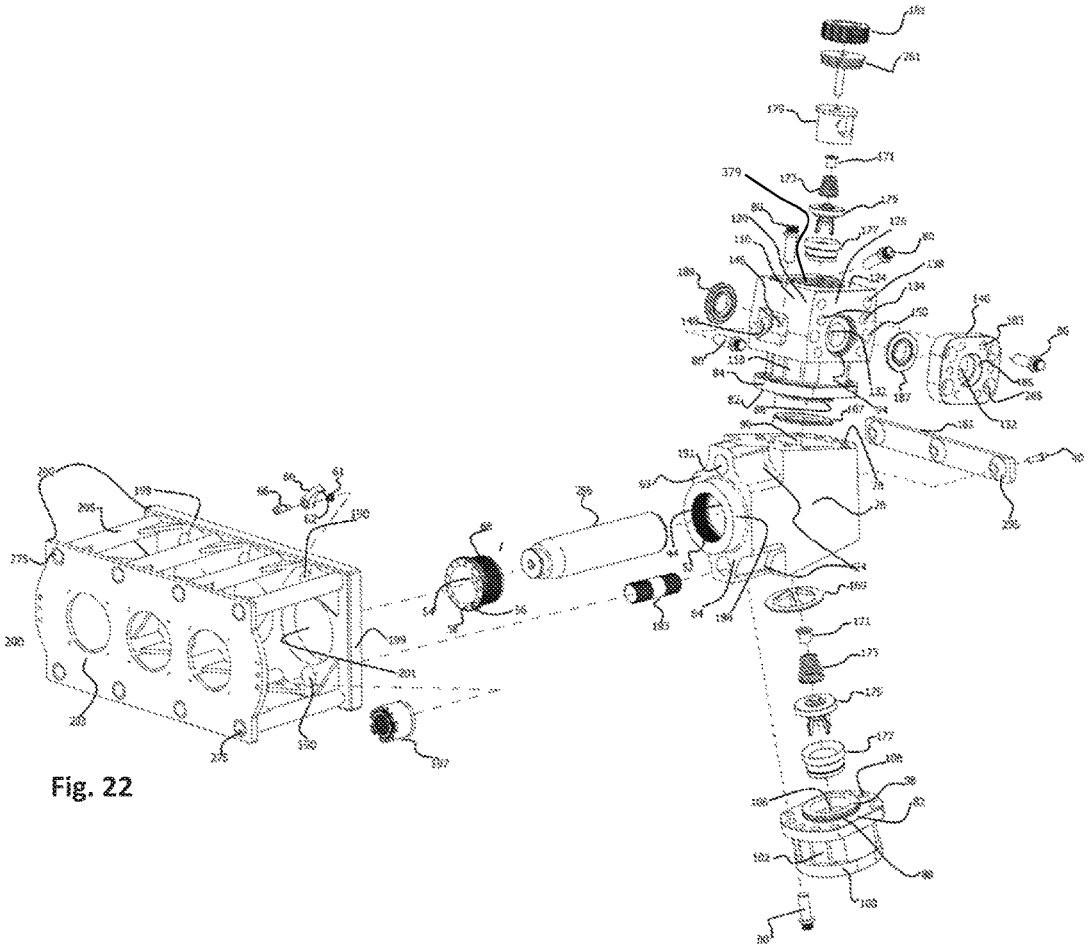
FIG. 22 is a front and side isometric exploded view of an angled head orientation individual assembly of a quick change stud style plunger manifold, an intake head, and a pressure head, in accordance with a preferred embodiment of the present invention showing adaptation of the quick change stud style plunger manifold to a component style power frame with use of a modified spacer section.
Figure 23:
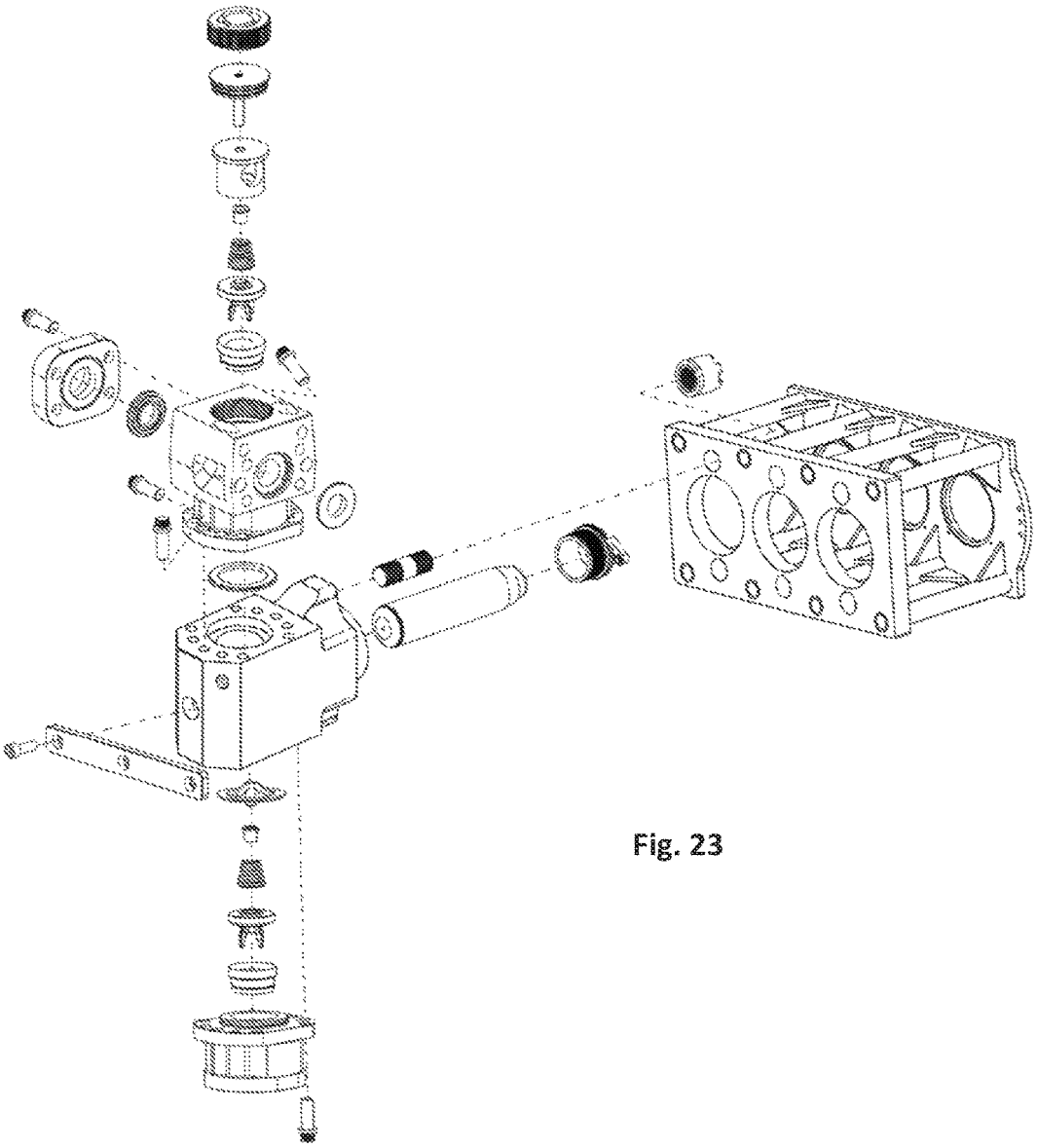
FIG. 23 is a rear and side isometric exploded view of an angled head orientation individual assembly of a quick change stud style plunger manifold, an intake head, and a pressure head, in accordance with a preferred embodiment of the present invention showing adaptation of the quick change stud style plunger manifold to a component style power frame with use of a modified spacer section.
Figure 24:
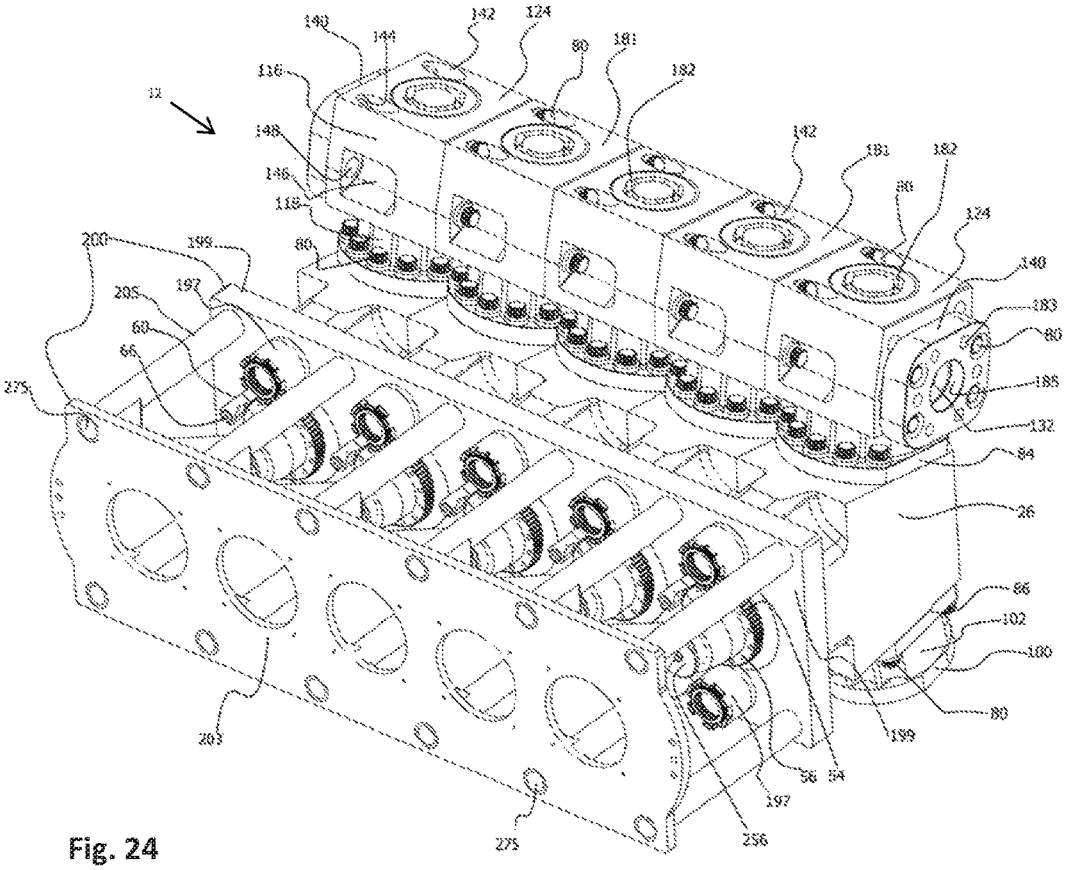
FIG. 24 is a front and side isometric view of an angled head orientation assembly of a quick change stud style plunger manifold, an intake head, and a pressure head, in accordance with a preferred embodiment of the present invention showing adaptation of the quick change stud style plunger manifold to a component style power frame with use of a modified spacer section.
Figure 25:
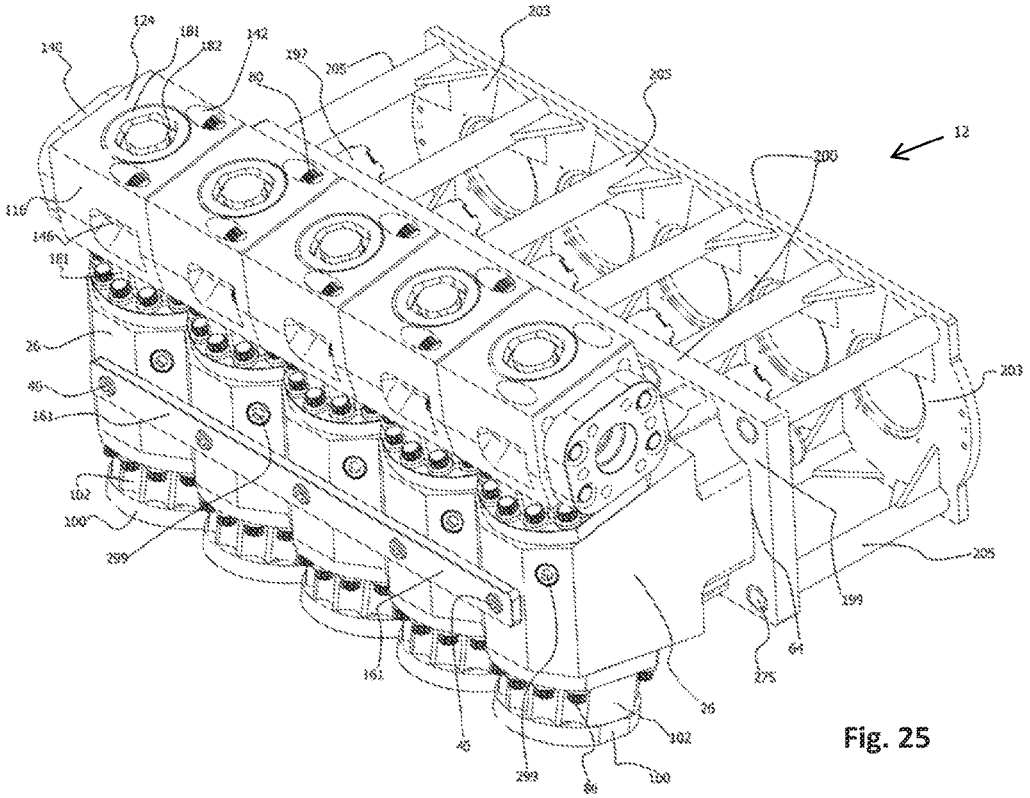
FIG. 25 is a rear and side isometric view of an angled head orientation assembly of a quick change stud style plunger manifold, an intake head, and a pressure head, in accordance with a preferred embodiment of the present invention showing adaptation of the quick change stud style plunger manifold to a component style power frame with use of a modified spacer section.
Figure 26:
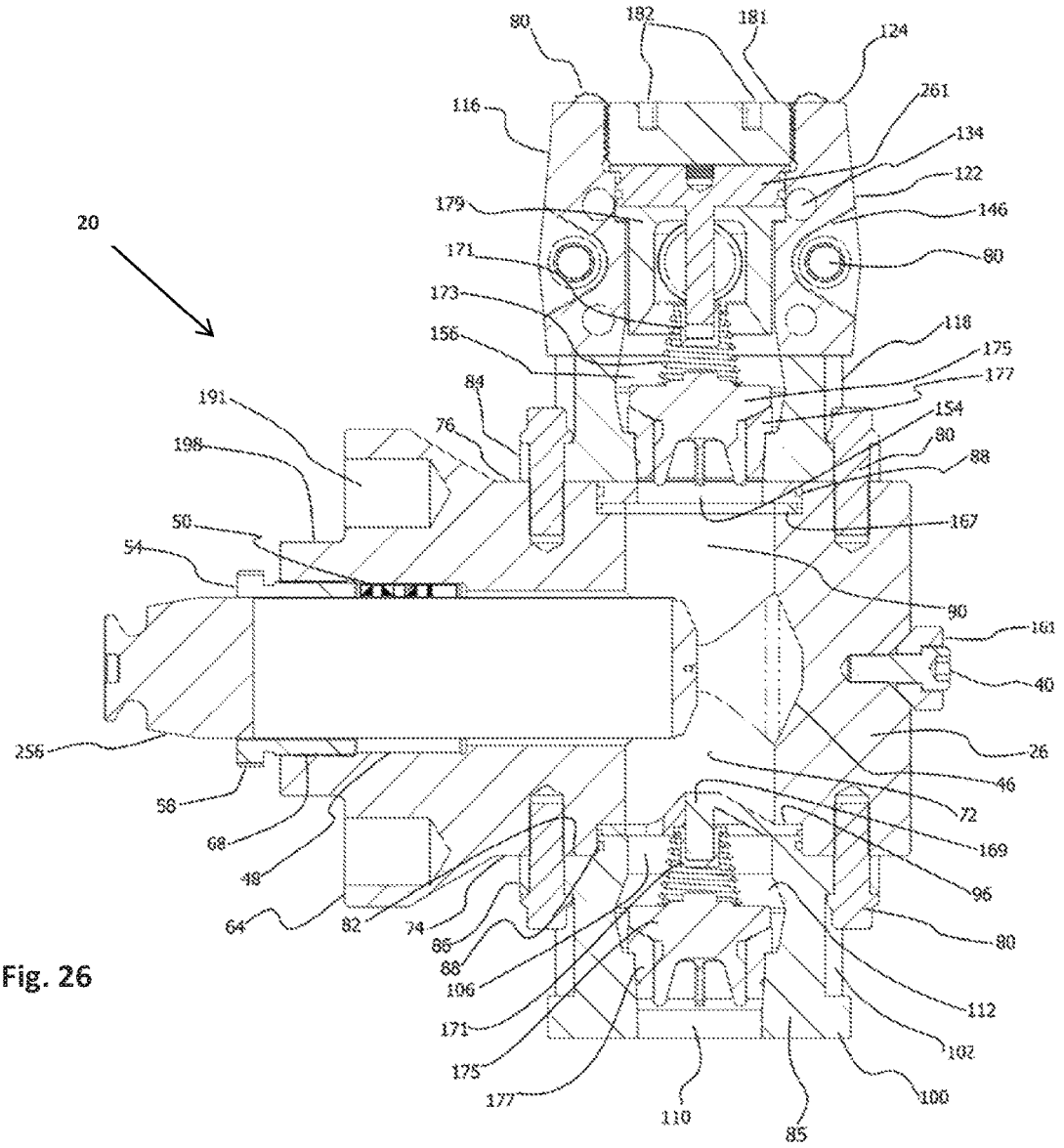
FIG. 26 is a side cut away view of a straight head orientation individual assembly of a quick change stud style plunger manifold, an intake head, and a pressure head, in accordance with a preferred embodiment of the present invention.
Figure 27:
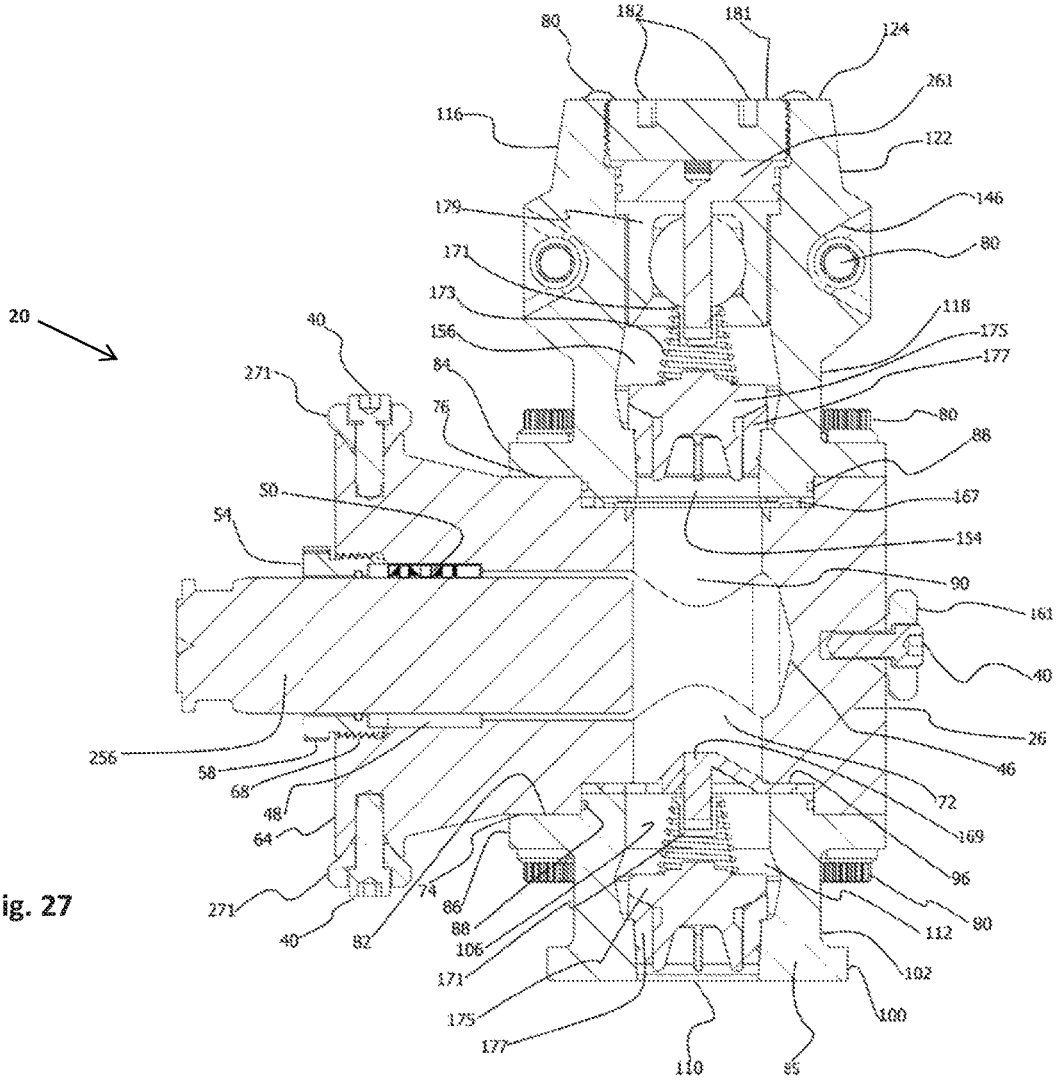
FIG. 27 is a side cut away view of a straight head orientation individual assembly of a stay rod style plunger manifold, an intake head, and a pressure head, in accordance with a preferred embodiment of the present invention.
Figure 28:
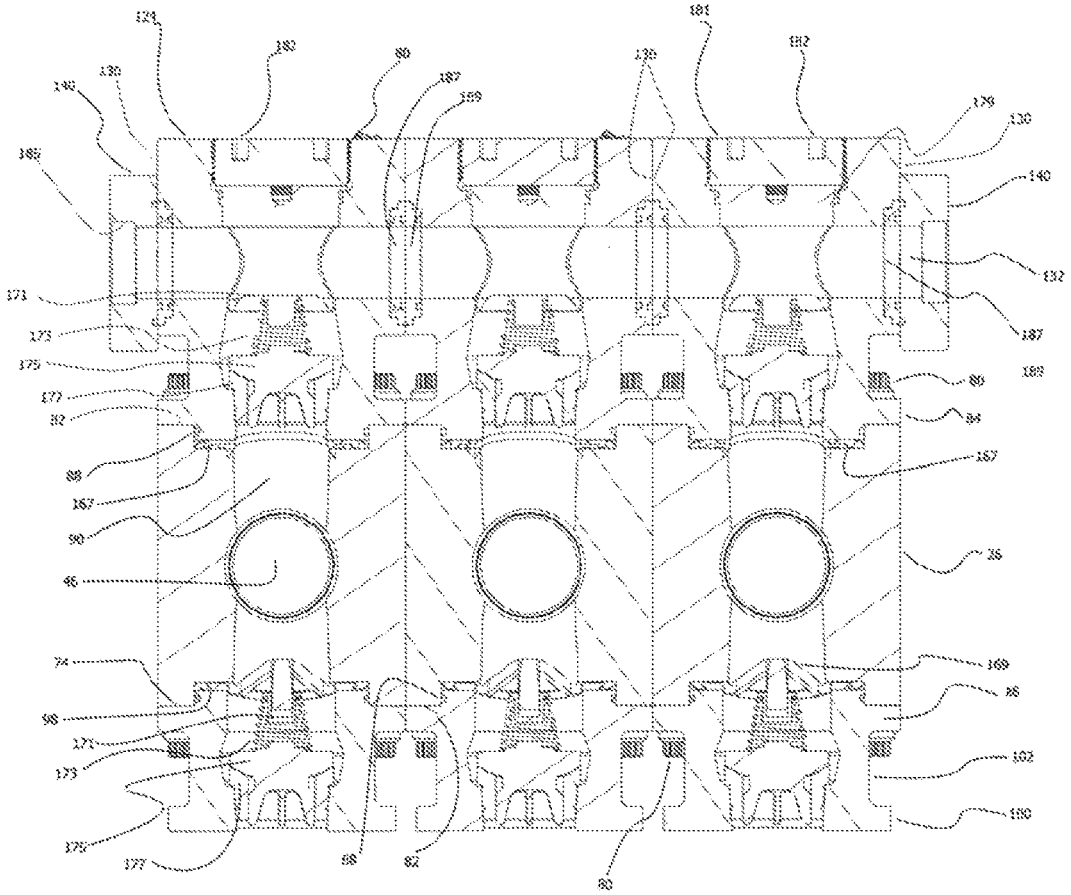
FIG. 28 is a front cut away view of an assembly of a plunger manifold, an intake head, and a pressure head, in accordance with a preferred embodiment of the present invention.

As best shown in FIGS. 22 and 27, the interchangeable design of the intake head 85, to be interchangeable in the field, comprises a new design valve spring retainer 169. In the preferred embodiment, only the intake head 85 uses the valve spring retainer 169. The valve spring retainer 169 offers a great support to the valve spring 173 and can be produced out of many long wearing materials and is easily replaced. The valve spring retainer 169 is a very open design. It has a stronger design than the conventional design spring retainers. Conventional spring retainers are changed every time the springs are replaced. The new spring retainer 169 will last for several valve changes. The intake valve spring retainer 169 is pinched between the plunger manifold opening 90 and the intake head 85. This makes it the easiest to install, remove and most reliable spring retainer available. To keep the heads, 85 and 116 completely interchangeable for fit on either side of the plunger manifold 26 a spacer has to be placed under the pressure head. Both the spring retainer and spacer may have seal glands to help seal against leakage between the plunger manifold 26 and pressure 116 and intake 85 heads.

The intake head valve holding body 102 is further adapted to receive a conventional and commercially available intake valve assembly 258, for example, an intake valve assembly 258 comprising a valve, valve spring and valve seat.

A valve spring retainer cap 171 offers a replaceable mating surface between the valve spring 173 and the valve spring retainer 169. The valve spring retainer cap 171 offers a wear shield against the frac fluids between the mating points of the spring retainer and spring.

The intake valve 175 opens and closes either by pressure applied or suction applied by the plunger 256 traveling in or out. The intake valves 175 see a great wear factor and have to be replaced several times during the life of the fluid end 12. Usually the valves 175 are the same for both intake and pressure heads. The pressure head valve 175 sees two to five times more wear than the intake valve.

The valve seat 177 is the mating surface to the valve 175 and also sees a great deal of wear. It is usually pressed into the different heads.

Thus, in the preferred embodiment, the intake chamber 106 comprises an intake head frac fluid supply side of valve 110 and a bottle bore 112. The intake head frac fluid supply side of valve 110 is the opening in the intake head 85 that frac fluid is supplied to the fluid end from the intake manifold 276. The bottle bore 112 comprises an area that performs as a deceleration area and permits clearance for the frac fluid to pass around the valve into and out of the segmented assembly. The conventional bottle bore 112 is one of the main reasons expensive machinery must be used to machine the mono block fluid end 281 or mono block style segmented head 303. The bottle bore 112 configuration of the present invention brings down the overall cost of machining the head because of the easy access in the bore with standard inexpensive machinery. The size and weight of the mono block 281 and one piece segmented head 330 (FIGS. 6-8) also make it mandatory for large expensive boring mills.

In the preferred embodiment, the intake head frac fluid supply side of valve 110 portion comprises a cross sectional diameter of 5½ inches even though this size can change with larger or smaller sized plungers. Though the bottle bore 112 comprises a conventional cross section, the modular design of the intake head 85 permits the bottle bore 112 to be machined with a lathe due to size and easy access to the bores of the intake head 85. In conventional mono blocks, the intake head cannot be turned on a lathe because of the large size and non-symmetrical configuration of the mono block 281 and one piece segmented head 330. Therefore, the intake chamber of a mono block must be machined using expensive large boring mills and special Cogsdill type boring heads to reach up inside of the mono block fluid ends. Milling is considerably slower than the same work being performed in a lathe. In contrast, the bottle bore 112 of the present invention can be readily formed using a conventional and relatively inexpensive metal working lathe. Thus, the bottle bore 112 of the present invention may be formed more quickly and less expensively than the intake chamber of conventional mono block designs.

The pressure head 116 can be easily removed and replaced. Due to the design of the seals that seal the pressurized frac fluid from one pressure head 116 to the next, the user can remove any center cylinders without removal and disassembly of the entire fluid end 12. All other segmented heads assemblies have to be removed from the power frame, with heavy weight handling equipment, and disassembled to replace any of the sections of the one piece segmented head 331. The main reason is their sealing system between adjoining cylinders. The seal bushing 334 spans between the respective discharge paths 266 causing the heads to have to be pulled apart instead of sheared apart, as allowed in the preferred embodiment. If the pressure head 116 has been damaged, needs a valve change, or is worn out, it can be easily replaced. In the mono block style head when just one intake or pressure side of the head is worn out or cracked, in just one cylinder, the entire mono block style fluid end has to be replaced. In the one piece segmented head 331, if a segment 330 is damaged or worn out the one piece segmented head assembly has to be unassembled and the entire segment is scrapped and has to be replaced. With the pressure head 116 light handling weight and design the pressure head 116 is easily separated and removed from the segmented fluid end 12 assembly. Nothing but simple wrenches can be used to remove the pressure head 116 and replace it with a new or reworked pressure head 116. When reworking the pressure head 116, the valve, spring, valve seat can be replaced with all new parts or just the parts that are worn or broken. Replacement of either valve, valve seat and valve spring in the mono block fluid end or one piece segmented fluid end can interfere with each other requiring the user to pull one valve assembly to work on the other, In the preferred embodiment 85, 116 that extra labor and expense does not occur because the user works on the heads as separate entities. Replacing a worn valve assembly is a very time consuming process in the mono block 281 and one piece segmented head 331. The pressure 175 or intake valve 175, seat 177 or spring 173 needs to be replaced frequently. The spring 173 is the weakest part of the valve assembly. Valve springs have a finite life and wear and weaken during operation. As a spring becomes weaker, the valve is not pushed down into the seat as quickly and "lags" above the seat. The valve is then slammed down on the seat by the pressure or intake stroke of the plunger. This slamming action can damage the valve and the seat. To prevent this, maintenance personnel should change the spring every time the valve is replaced. When valve seats have been in service for a significant amount of time, they can be difficult to remove for replacement. A hydraulic valve seat puller is used for this task. A hydraulic valve seat puller consists of a pancake-style hydraulic cylinder, a high-pressure hand pump, a stabilizing block, a pulling screw and a pulling head. The stabilizing block bridges the access bore of the discharge cover, giving the pancake cylinder a firm surface on which to sit while in operation. The cylinder pulls a pulling head with the pulling screw. This is the method used in changing the valve assembly in the mono block 281 or one piece segmented head 330. This very slow and costly operation and is amplified by larger cylinder count. This maintenance is the largest contributor of lost time and money to the mono block and one piece segmented fluid end. The maintenance has to be performed frequently.

With the new design, the user unbolts the affected pressure or intake heads and bolts in either a new or rebuilt head and quickly puts the pump back into operation. Only a running pump makes money. The removed heads can then be rebuilt back at a service center. Even rebuilding the heads in the service center is much faster because of the easily handled weight and size of the heads. The parts are easily cleaned and have easy access to the valve seats for power removal and installation.

Replacement of the segmented pressure head 116 is 300 to 600% faster than the time that it takes to change valves in the mono block 281 or one piece segmented style head 330. In the mono block and one piece segmented style head, when the user changes the pressure valve assembly, the user changes the intake valve assembly because the user does not want to have to stop again to change a valve that may go down when the user could save that expense by changing all valves when the heads require access. It is more expensive to follow this procedure, but this has been proven to save money with the mono bock and one piece segmented head design. The valve changes are so quick and easy in the new design that if the pressure valve is worn out and the intake valve is not, the user only has to change the valve that needs replaced. Valve changes occur frequently and are a major money loss due to the way and the time the intake and exhaust pressure valves in the mono block 281 and one piece segmented 330 head have to be changed. The pressure side valve and pathways always wears out faster than the intake side. With the design of the segmented fluid end 12 the user will get longer life out of the valve assemblies because the user can let the parts wear out, instead of some statistical predetermined maintenance schedule that forces the user to change both valves, and then they can be easily replaced.

The pressure head 116 houses the pressure valve 175 and has common attachment areas for exit of frac fluid, under pressure, to the pressure discharge outlets 132. The pressure head 116 of the preferred embodiment is a one piece body comprising the pressure head mounting flange 84, a valve holding area, entry and exit paths for the frac fluids, recesses for sealing glands, a large access entry at the top for installation and removal of the pressure valve 175 and flow control, spring retainer, and wear sleeve 179 (collectively "flow control valve" 179 or "FCV" 179) and a pressure head valve holding body 118 extending between the discharge cover area and the pressure head mounting flange 84. The pressure head valve holding body 118 houses the pressure valve assembly.

As mentioned, in the preferred embodiment, only the intake head 85 uses the valve spring retainer 169. As shown in FIGS. 22 and 27, to maintain a symmetry of the head mounting sides of the plunger manifold 26, the pressure head 116 comprises a valve spring retainer replacement spacer 167 to make up for the lack of the valve spring retainer 169.

Figure 7:
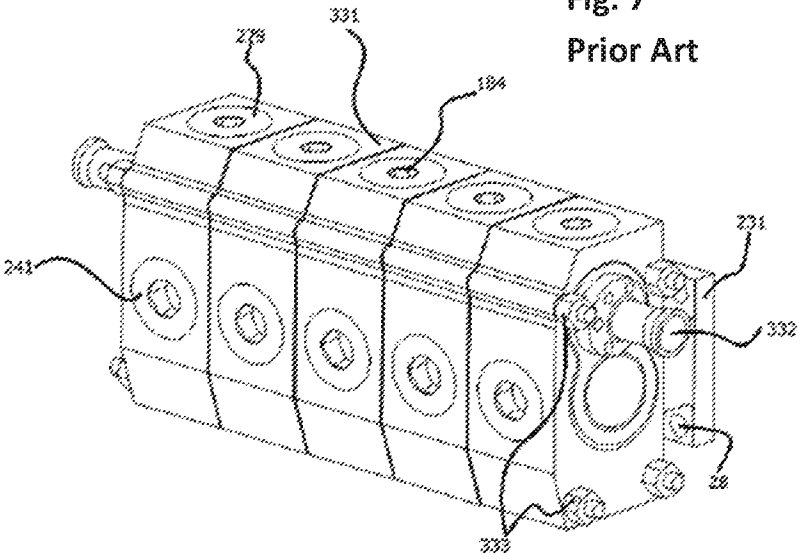
Fig. 7 Prior Art
FIG. 7 is an isometric view of an assembled prior art one piece segmented fluid end.
Figure 6:
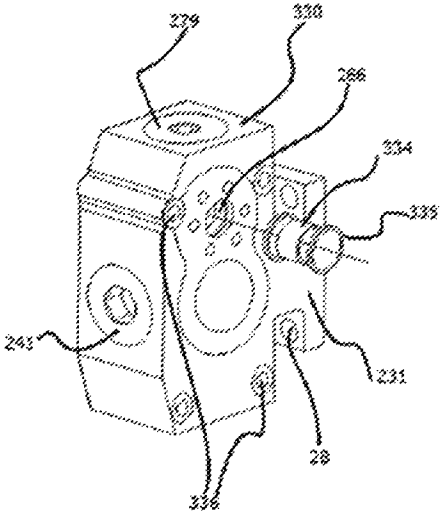
Fig. 6 Prior Art
FIG. 6 is an isometric view of a prior art single section of a one piece segmented fluid end.
Figure 8:
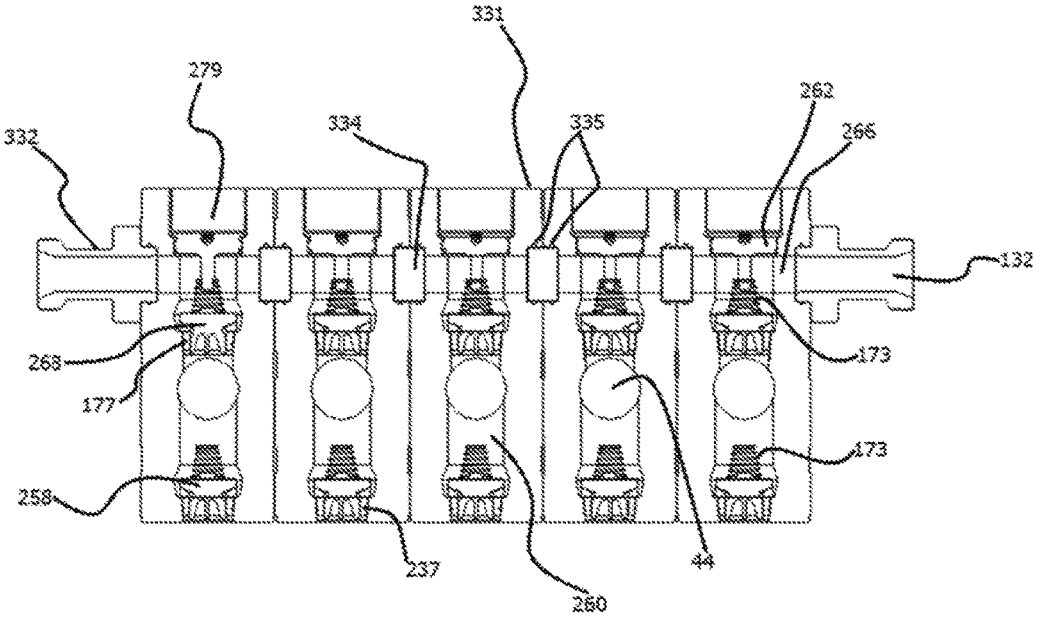
Fig. 8 Prior Art
FIG. 8 is a cross-sectional cut-away view of an assembled prior art one piece segmented fluid end.
Figure 9:
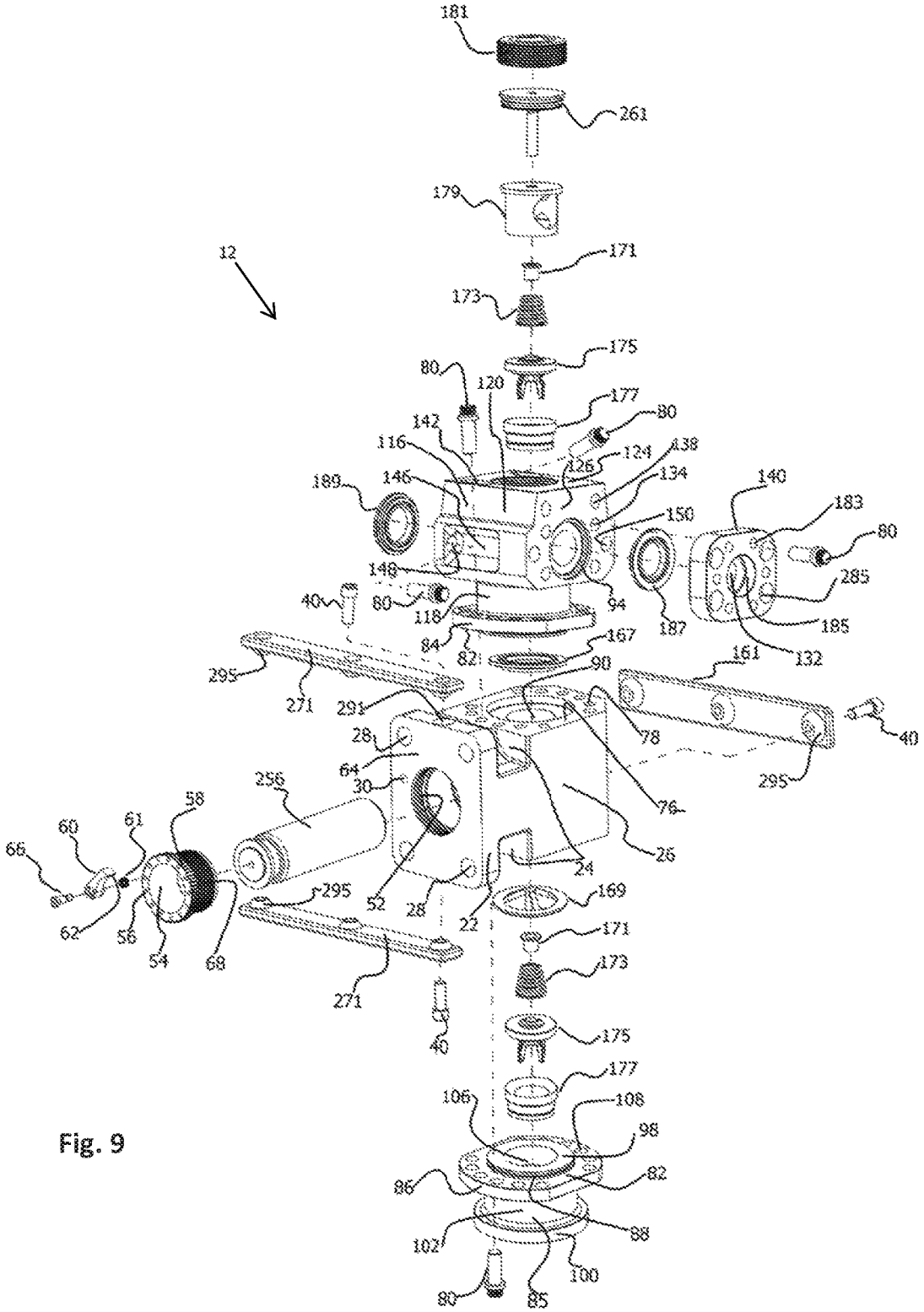
FIG. 9 is a front and side exploded isometric view of a straight head orientation individual assembly of a stay rod style plunger manifold, an intake head, and a pressure head, in accordance with a preferred embodiment of the present invention.
Figure 10:
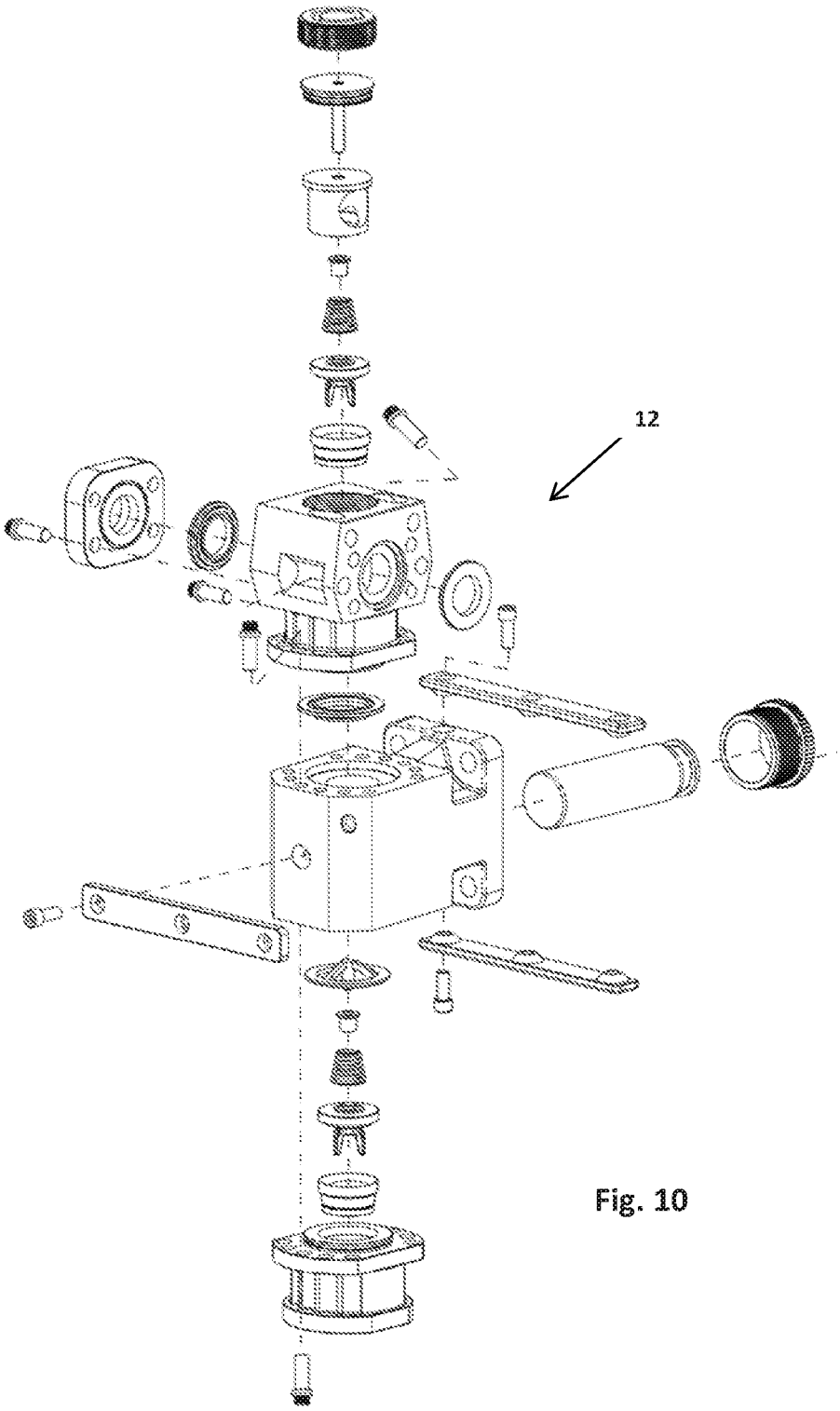
FIG. 10 is a rear and side exploded isometric view of a straight head orientation individual assembly of a stay rod style plunger manifold, an intake head, and a pressure head, in accordance with a preferred embodiment of the present invention.
Figure 11:
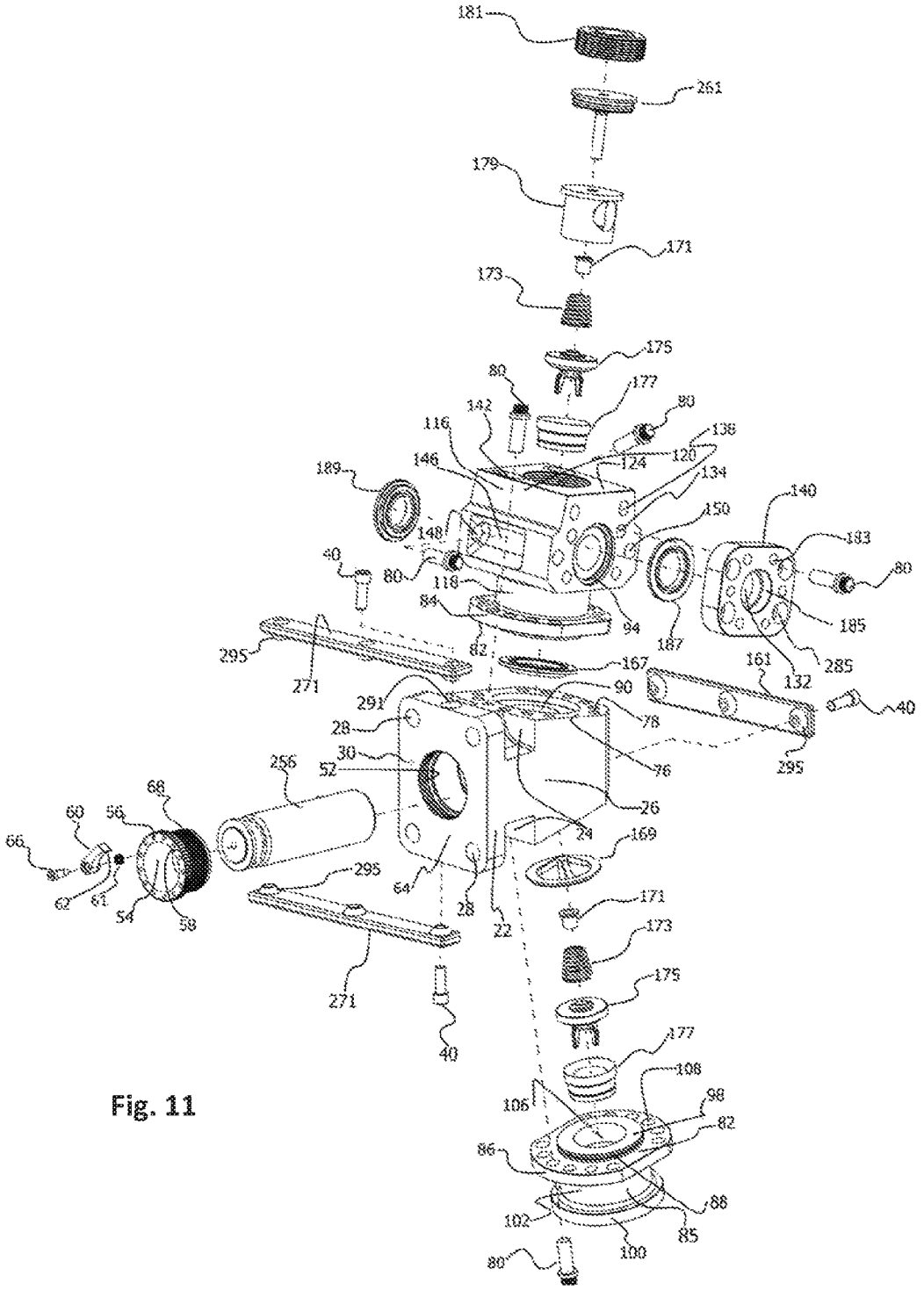
FIG. 11 is a front and side exploded isometric view of an angled head orientation individual assembly of a stay rod style plunger manifold, an intake head, and a pressure head, in accordance with a preferred embodiment of the present invention.
Figure 12:
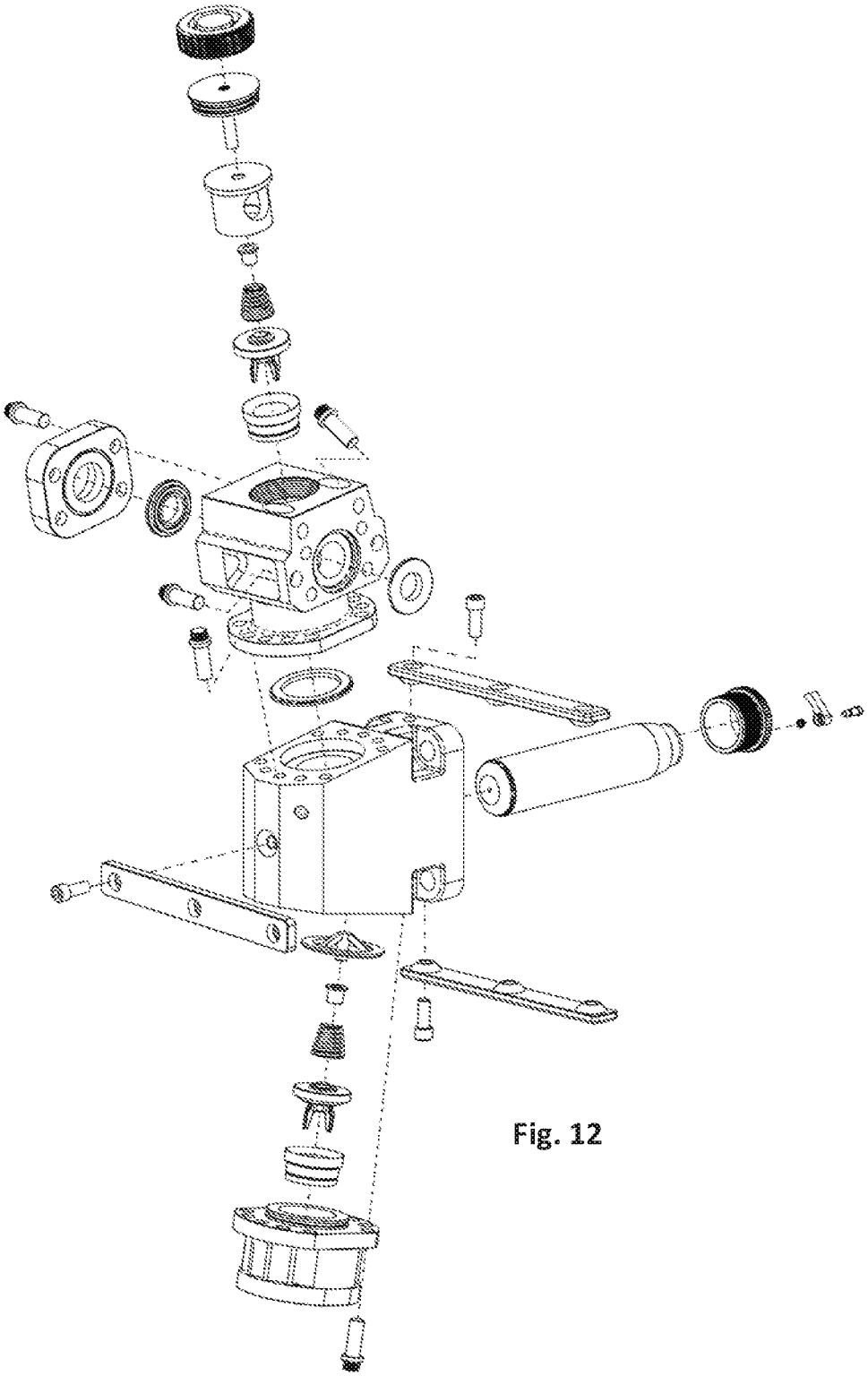
FIG. 12 is a rear and side exploded isometric view of an angled head orientation individual assembly of a stay rod style plunger manifold, an intake head, and a pressure head, in accordance with a preferred embodiment of the present invention.
Figure 13:
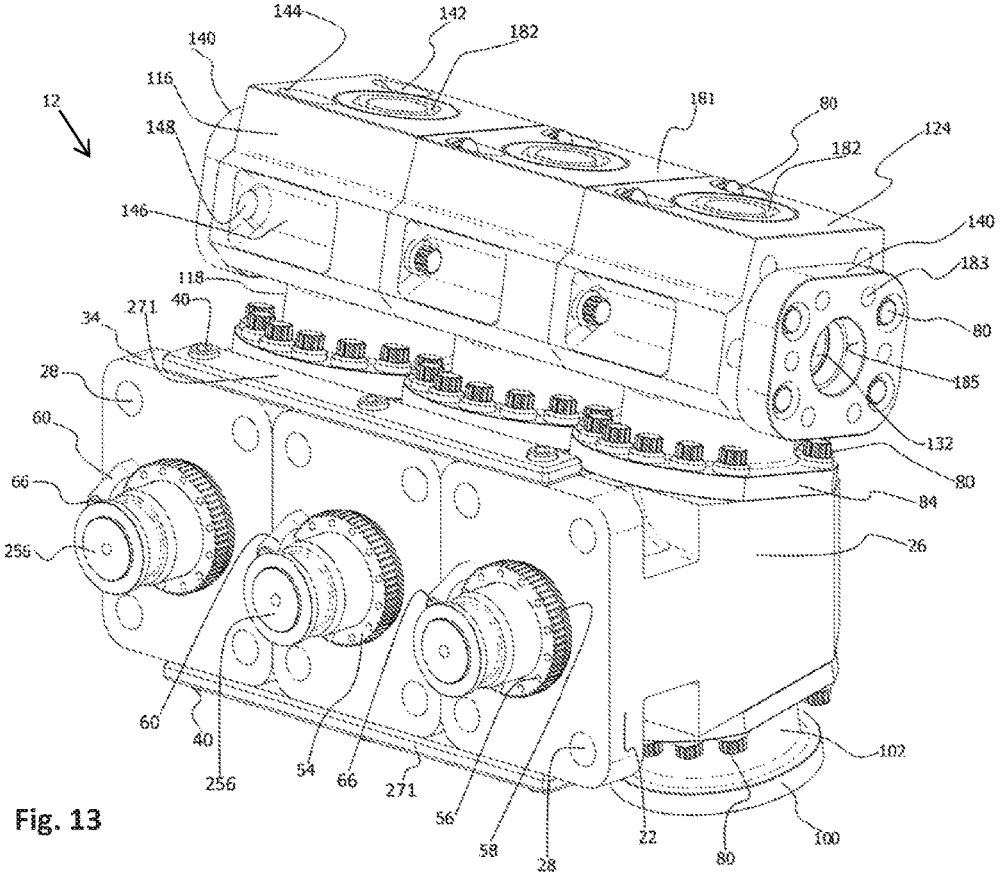
FIG. 13 is a front and side isometric view of an angled head orientation assembly of a stay rod style plunger manifold, an intake head, and a pressure head, in accordance with a preferred embodiment of the present invention.
Figure 14:
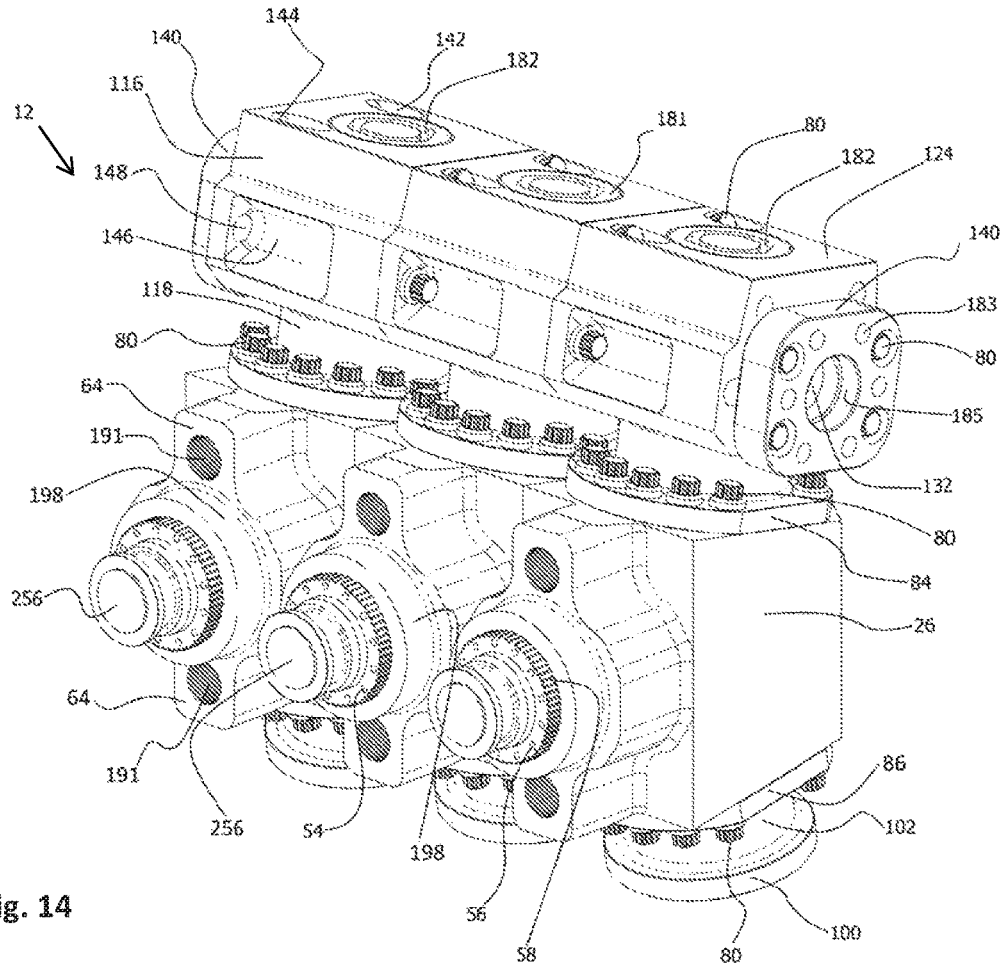
FIG. 14 is a front and side isometric view of an angled head orientation assembly of a quick change stud style plunger manifold, an intake head, and a pressure head, in accordance with a preferred embodiment of the present invention.
Figure 15:
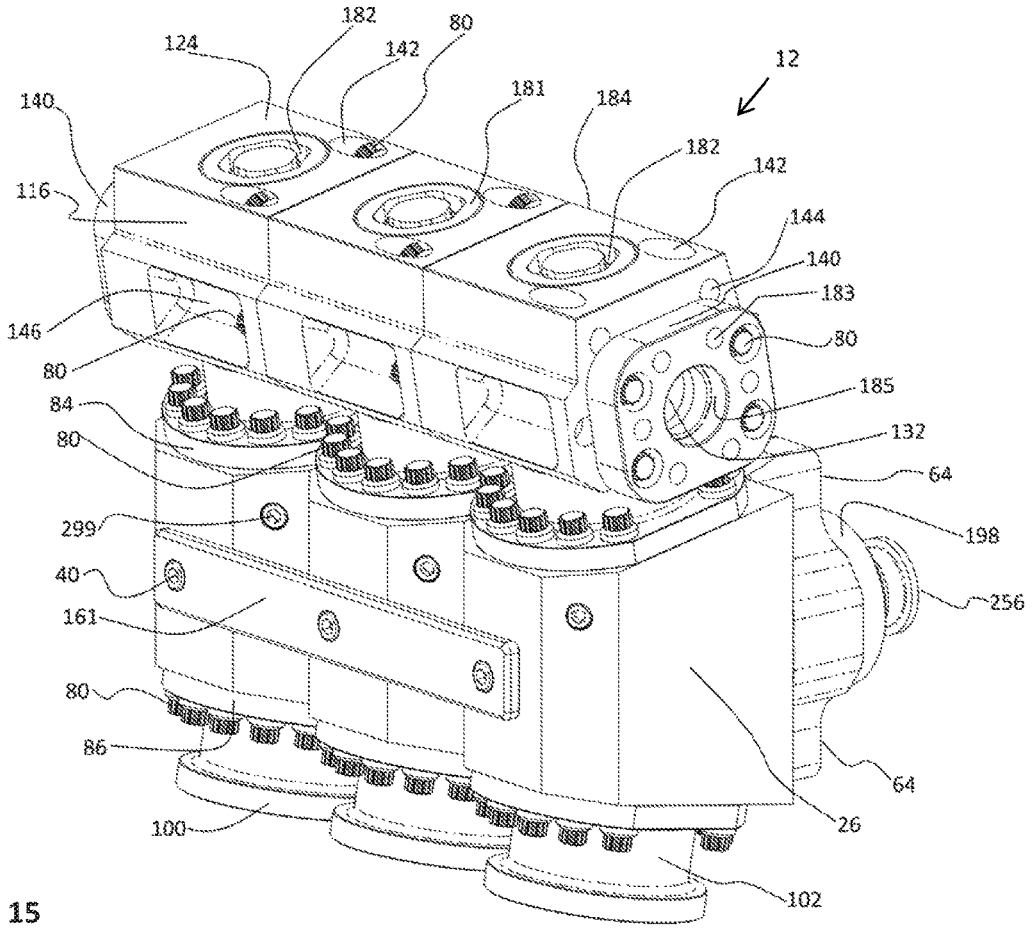
FIG. 15 is a rear and side isometric view of an angled head orientation assembly of a quick change stud style plunger manifold, an intake head, and a pressure head, in accordance with a preferred embodiment of the present invention.
Figure 16:
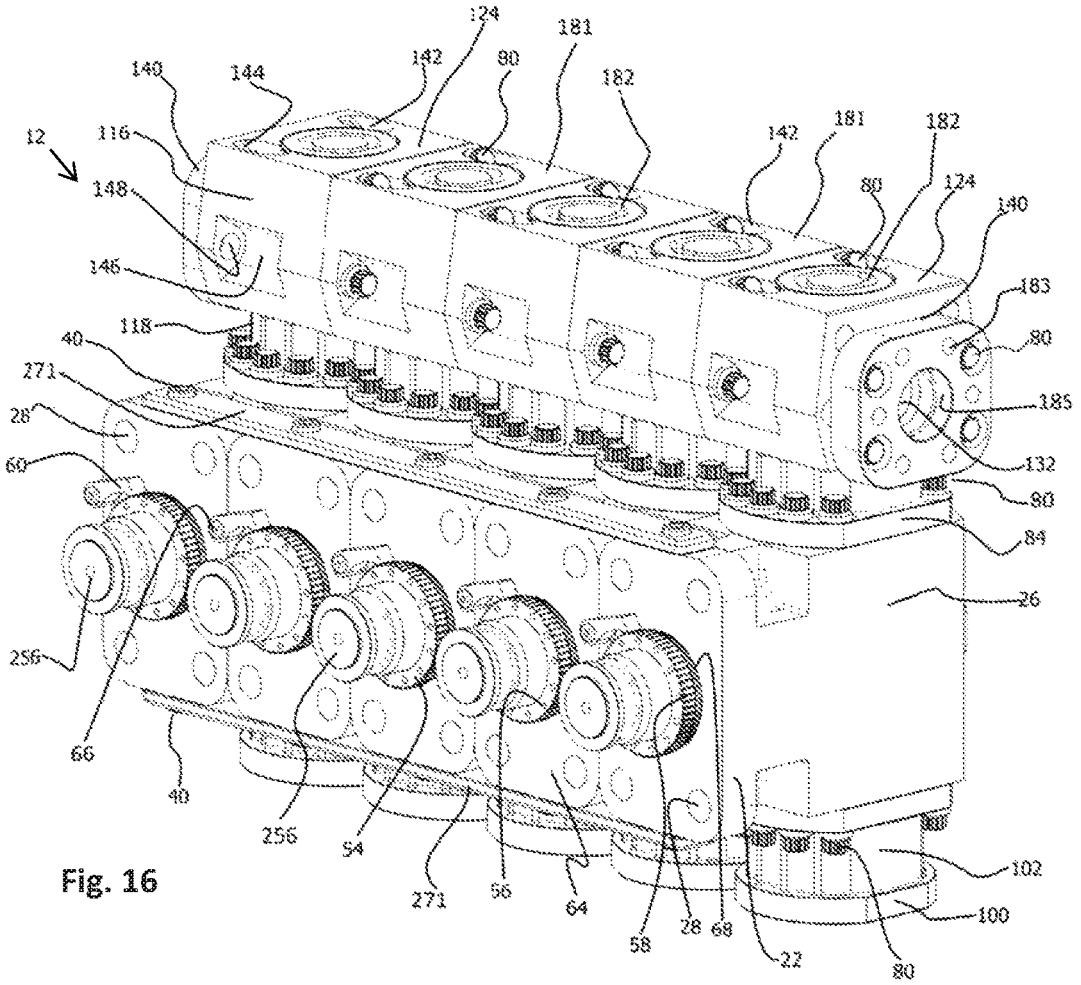
FIG. 16 is a front and side isometric view of a straight head orientation assembly of a quick change stayrod style plunger manifold, an intake head, and a pressure head, in accordance with a preferred embodiment of the present invention.
Figure 17:
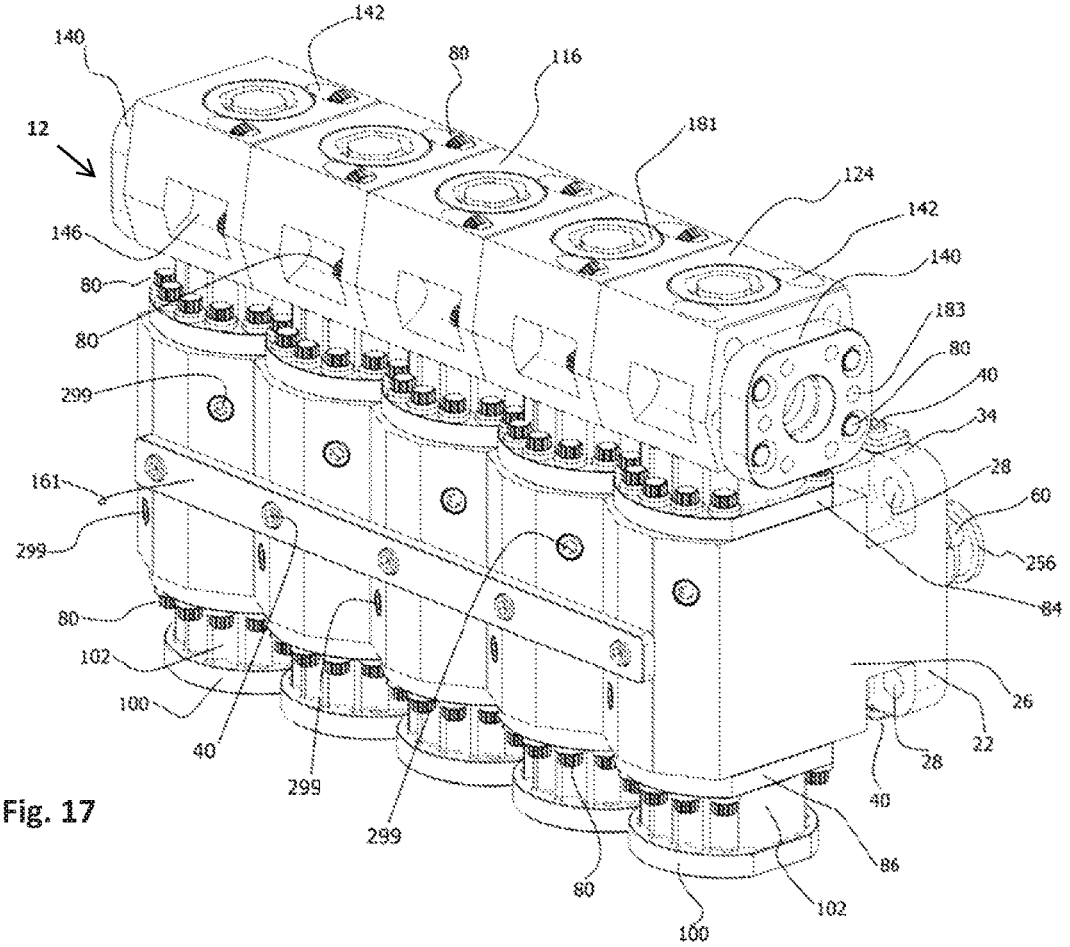
FIG. 17 is a rear and side isometric view of an straight head orientation assembly of a quick change stayrod style plunger manifold, an intake head, and a pressure head, in accordance with a preferred embodiment of the present invention.

The pressure head 116 main body comprises forward and rearward sides 120 and right 126 and left 128 sides. The forward and rearward sides 120 are identical to each other such that either side 120 can be mounted facing forward or rearward. The terms "right" and "left" sides are the sides 126, 128 of the pressure head main body 116 as seen when viewing the pressure head 116 from the plunger chamber opening 90 side of the manifold 26 when the pressure head 116 is connected to the manifold 26. In the preferred embodiment, the pressure head main body right side 126 comprises threaded openings that permit connecting one pressure head 116 segmented head to the next. The left side 128 has through holes for a fastener to pass through to the right side 126. Solid bars could also be used spanning all pressure heads 116 to keep them pressed together similar to what is shown in FIG. 7.

The pressure head main body upper side 124 is the side opposite the pressure head mounting flange 84. The pressure head main body upper side 124 is shown up in the illustrations. However, the pressure head main body upper side 124 can be mounted downward which possibly could help the fluid end perform better by helping cut down on cavitation. The industry standard is up. The reason almost all fluid ends have this surface up is to assist in valve changes. The methods and tooling used in changing the valves are not easily used in the upside down position. This new design does not rely on gravity to assist in maintenance. The mono block and one piece segmented fluid end designs cannot explore other benefits that may be gained by intakes being in the up position.

The pressure head right 126 and left 128 sides each comprise flat mating surfaces (faces), a pressure discharge outlet 132, and a plurality of fastener receiver openings 134, 138, 150. In the preferred embodiment, four of the fastener receiver openings 134, 138, 150 comprise threaded openings 134 adapted to receive fasteners 80 for coupling a pressure adaptor 140 to the pressure head 18. Two of the fastener receiver openings 134, 138, 150 are horizontal through openings 150 adapted to receive fasteners 80 for coupling one pressure head 116 to an adjacent pressure head 116. These attachment areas can be placed in a variety of positions with different fastener counts. These connection openings 150 are on center alignment of the discharge outlets 132 of the pressure head 116. One side of the pressure head 116 is a through hole and the other is threaded to accept a fastener bolt. They hold one head 116 to the next. There is no limit on the amount of heads 116 that can be connected. This method of fastening the heads 116 together does away with external bars and brace and allows the user to swap the head 116 without disassembly of the entire fluid end 12.

Two of the fastener receiver openings 134, 138, 150 are angled through openings 138 adapted to receive fasteners 80 for coupling one pressure head 116 to an adjacent pressure head 116. These attachment areas can be placed in a variety of positions with different fastener counts.

The discharge connection adapter 140 of the preferred embodiment permits the pressure head 116 to be coupled to a conventional pressure outlet comprising a particular bolt pattern. For example, in the preferred embodiment, the discharge connection adapter 140 comprises four discharge connection adapter to pressure head counter bored thru holes 285 in a four bolt pattern which permits the discharge connection adapter to be coupled to a pressure outlet flange comprising a four bolt pattern. These four counter bored openings 285 hold the discharge connection adapter 140 to the pressure head. The use of this discharge connection adapter 140 for the discharge connection allows frac fluid to exit the outside face of each segmented fluid end assembly 20. The male and female seal plates in use with the discharge adapter plate permit the heads to be removed individually. It keeps the pressure head 116 from having dedicated sides for sealing which allows the pressure head to be mounted left or right. Thus, the discharge connection adapter 140 can be coupled to either the left side 128 or right side 126 of the pressure head 116. This adapter 140 is what allows any style or any size conventional discharge connection to be used with the design. A built-in discharge connection interface 185 such as one that is built into the one piece fluid end segment 266 would require a seal bushing 334 and a complete tear down of the assembly 331 to get a fluid end segment 330 out of the assembly 331 because the seal bushing 334 bridges the adjacent segment and the have to be pulled apart and cannot be sheared apart. Also, to keep the fluid end segments 20 completely interchangeable with one another, both sides of all fluid end segments 20 are the same. A male seal ring 189 or female seal ring 187, together with the discharge connection adapter 140 allows this interchangeability. This means a user need only stock one style of pressure head 116 and one style of discharge connection adapter 140. A great cost savings in many ways. A discharge connection mating seal surface 185 ensures that there is a good seal between the discharge connection adapter 140 and the discharge connection. This is a high pressure area.

In the preferred embodiment, the female seal ring 187 and male seal ring 189 are each steel rings with two flat sides. The male seal ring 189 is flat on one side and has a seal gland machined into the other. When installed, the gland side is mounted into the head leaving the flat side exposed. The female seal ring 187 has a seal gland machined into both sides. When installed one side is inserted into the mating head leaving the second side seal gland exposed. When the pressure heads are installed properly, the head with the flat side of the male seal ring 189 exposed provides the head with the female seal ring 187 exposed a place to seal against. Since the exposed surfaces of each seal ring 187, 189 are flat and have no protrusions, they can slip by each other. This permits the user to pull one of the center heads out without complete disassembly as in the one piece segmented head assembly 331. The seal rings 187, 189 are completely interchangeable. When the segments are assembled 20 the user installs seal ring 187 into each outside discharge area of the exposed pressure head 116 The discharge adapter 140 is flat on the side mounted against the head giving the exposed seal in the steel ring gland a place to seal against. This design yields a zero clearance mating surface that with a standard O ring 380 (FIG. 18) can seal against pressures way over 100,000 lbs. per sq. Inch. This allows for quick and easy removal and installation of a pressure head 116 in the field without disassembly of the entire fluid end assembly 12.

The pressure head main body upper side 124 comprises one or more fastener opening counter bores 142 which permit one pressure head 116 to be coupled to an adjacent pressure head 116. In the preferred embodiment, the fastener opening counter bores 142 are near the pressure head left side 128 and comprise top pressure head through openings 144 which permit a fastener 80 to be inserted angularly through the pressure head main body upper side 124, the pressure head main body left side 128, and into the angled through openings 142 in an adjacent pressure head 116 right side 126. The fastener opening counter bore 142 configuration permits the bolt head of the fastener 80 to lie slightly beneath the upper side surface 124 when the fastener 80 is so inserted. This counter bore 142 provides clearance, for example, for the head of a bolt 80 and gives the head of the bolt 80 a flat surface to torque against. The placement of the fasteners 80 in the top of the head at an angle give added strength to hold the heads 116 together from the pressure being transferred between the pressure heads 116. These attachment areas can be placed in a variety of positions with different fastener counts.

The forward 120 and rearward 122 sides of the pressure head main body 116 each angle outward from the pressure head main body upper side 124. Each of the forward 120 and rearward 122 sides comprises a pressure head side tie together bolt clearance area 146 comprising left and right 150 fastener openings. The size and shape of this bolt clearance area 146 permits large diameter and long bolts to be used. The bolt clearance area 146 also has a side benefit of helping reduce weight.

Such left and right 150 fastener openings, top pressure head through openings 144, permit the pressure head 116 to be coupled to an adjacent pressure head 116. A bolt 80, for example, fits through this top pressure head through opening 144 and screws into the next pressure head threaded openings 138. In the preferred embodiment, all through-hole fastener openings, that help seal off the discharge openings are on the same face of the each pressure head 116 and all threaded openings, that help seal off the discharge openings are on the opposite face of each pressure head 116

The steel seal rings 187, 189 seal against pressure loss between the mounted pressure heads 116. The seal plates are brought into close contact 187, 189 when the pressure heads are torqued together, so that the seals used prevent leakage between the discharge outlets of each. There are several types of seal ring materials and seals in slip fit sealing systems that could be used for different applications the pressure heads 116 could be used in.

The pressure head 116 comprises a generally "t" shaped internally discharge chamber 152 that has an internal pressurized fluid path extending from the plunger manifold pressure chamber 72 into the pressure head 116 and out the left 128 and/or right 126 pressure head pressure discharge outlets 132, 132. This is the path that the frac fluid will follow to exit the fluid end assembly 12. The fluid can track in either direction or both directions at once. The direction depends on the setup at the fracking location.

The discharge chamber 152 is further adapted to receive a conventional and commercially available discharge valve assembly 175, for example a discharge valve assembly 175 comprising a valve, valve seat, and valve spring such that the discharge chamber 152 comprises a narrow inlet portion 154 within the pressure head mounting flange 84, a mid-portion comprising a pressure head bottle bore 156 within the pressure head valve holding body 118, and a narrow upper portion 158. In the preferred embodiment, the narrow portions 154, 158 each comprise a diameter of approximately 5½ inches.

The narrow inlet portion 154 area shapes the pressurized charge to feed the pressure valve 175 evenly. This pressure head bottle bore 156 comprises an area that permits clearance for the frac fluid to pass around the valve 175 and exit. Along with size and weight the conventional pressure head bottle bore 156 is, along with the conventional intake head bottle bore 112, are main reasons expensive machinery must be used to machine the mono block fluid end or mono block style segmented head. The difficulty in machining the bottle bore limits the hardness and material types in the mono block or one piece segmented fluid end. The pressure head bottle bore 156 configuration of the present invention brings down the overall cost of machining the head because of the easy access in the bore with standard inexpensive CNC lathes than the slower and much more expensive boring mills. This easy access allows the use of a larger variety of materials and much harder materials that will bring a longer life to the fluid end.

Figure 29:
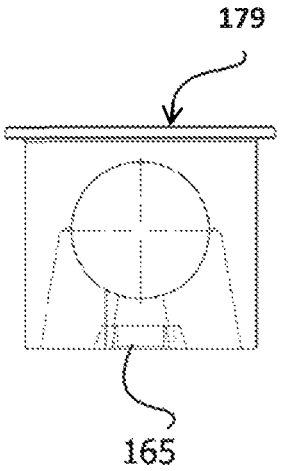
FIG. 29 is a front elevation view of a directional control valve, in accordance with a preferred embodiment of the present invention.
Figure 30:
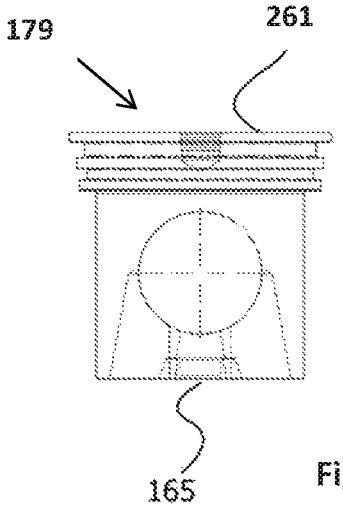
FIG. 30 is a front elevation view of a directional control valve, in accordance with another embodiment of the present invention.
Figure 31:
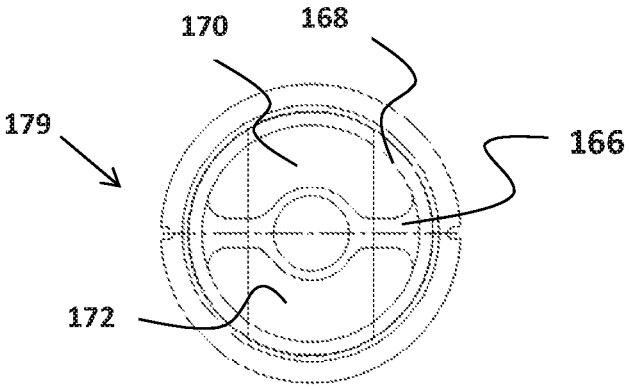
FIG. 31 is a top elevation view of the directional control valve of FIG. 29.
Figure 32:
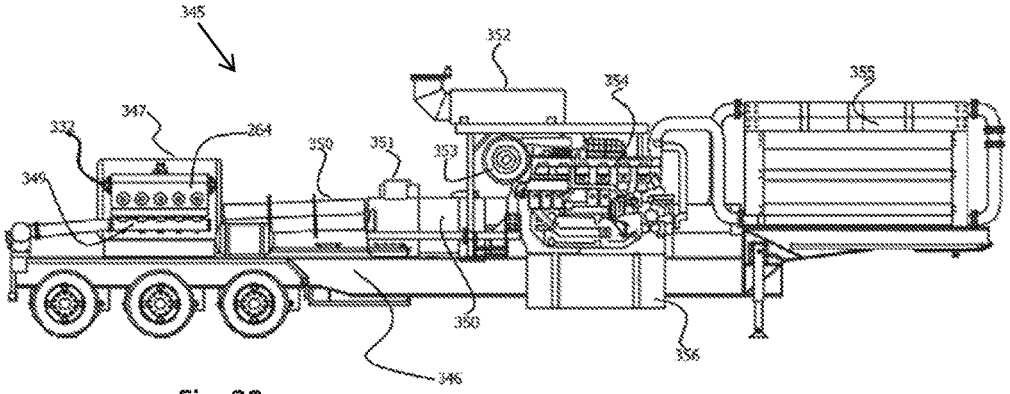
FIG. 32 is a side view of a complete frac unit ready to be put into service. This is a view of a quint fluid end setup. There would be no difference in what is shown in a triplex setup.
Figure 33:
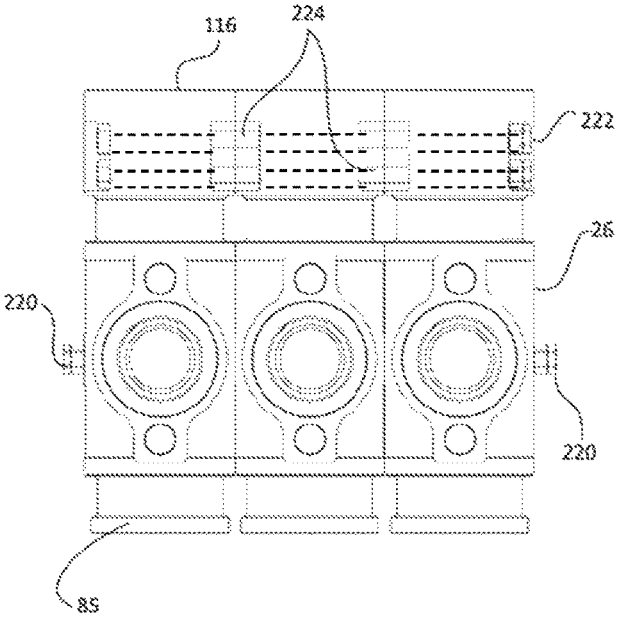
FIG. 33 is a front elevation view of the segmented fluid end comprising an alternative joining feature, in accordance with another embodiment of the present invention.
Figure 35:
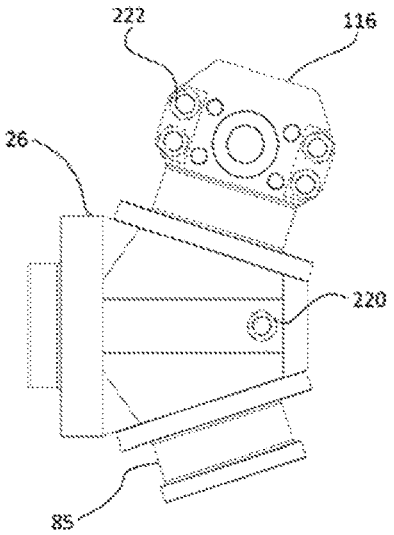
FIG. 35 is a side elevation view of the segmented fluid end of FIGS. 33 and 34.
Figure 34:
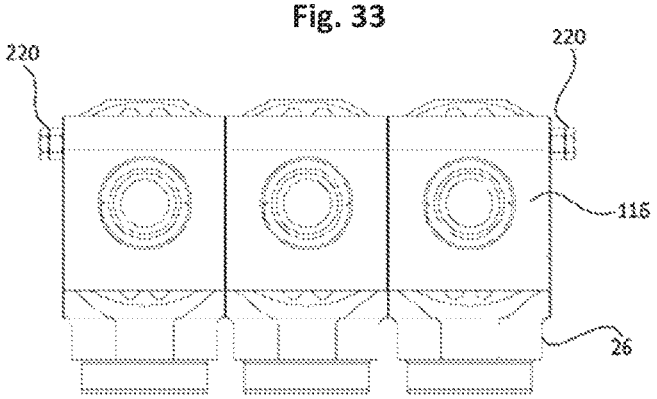
FIG. 34 is a top elevation view of the segmented fluid end of FIG. 33.

The large cavity above the bottle bore 156 up to the discharge cover is required for clearance to install and remove the pressure valve assembly. Left alone, this cavity would see uneven and elevated wear. The directional control valve 179 offers a proper flow direction for the frac fluid and a wear surface that will extend the life of the pressure head 116 by offering the FCV's 179 surface to wear instead of the inside walls of the pressure head 116 and will cut down on wear to the discharge cover 261. The directional control valve 179 also takes the channeled fluid and directs the flow directly into the discharge paths 132. The discharge path in the mono block 281 and mono block style segmented fluid end 330 cannot be channeled or directed due to design restraints. The discharge path 266 in the mono block style heads is in line with the top of the valve, valve spring, top of the valve seat and through the large valve access bore. Traveling from the small discharge bore 266 into a large cavity with a valve spring interfering with the flow and also the flow from the valve causing a turbulence not only causes aggravated wear to all parts but uses more horse power to push through the resistance. This interference and wear to adjacent bores is aggravated by the number of cylinders and especially if the flow is out just one side of the head. The directional control valve 179 in place makes the discharge path more of a straight consistent round bore that offers less wear and horse power eating resistance than the discharge paths of the mono block style heads. The discharge path 132 of the present embodiment from one head to the next is above the pressure springs 173 thus cutting down on the one-sided wear of the valve and the wear of the spring and turbulence created in the mono block 281 and one segmented fluid end 330. Also there is an even flow around the pressure valve 268 that will extend the life of the valve assembly because the flow around the valve is below and not interfered with by the flow of the main discharge path of the frac fluid as in the mono block 281 and one piece segmented fluid end 330. As shown, for example, in FIGS. 29-31 the directional control valve 179 is built with a pressure valve spring retainer 165 built into an end. In a preferred embodiment, the directional control valve 179 comprises a bridge 166 spanning between opposite sides of a control valve tubular wall 168. The valve spring retainer 165 of this embodiment is positioned at the approximate midpoint of the bridge 166. The bridge 166 defines first and second channels 170, 172 through which fluids flow, for example, when the pressure valve 175 is open. The directional control valve 179 can also be produced with a built in discharge cover 261 (FIG. 30). The directional control valve 179 can be made of many long wearing materials and is easily replaced. This wear and control surface cannot be used in the mono block 281 or one piece segmented head 116 due to design restraints.

A large socket discharge cover retainer nut 181 gives access to a discharge cover 261, pressure valve seat 177, valve 175, valve spring 173 and intake valve seat 177. A conventional fluid end has two retainer nuts 181 per cylinder. The discharge retainer nut 241 in back of the conventional fluid end gives access to the intake valve seat 177, valve 175, and valve spring 173 and will have a spring retainer designed to hold the valve spring 173 in place. In some designs the spring retainer is actually attached to the discharge cover nut 241 and the other style will have a groove machined into the body of the fluid end in an area above the intake spring that will eventually wash out requiring replacement of the fluid end. All intake spring retainers are small and weak and fail frequently. Access through the top discharge retainer opening 279, in the conventional design is used to press in and remove the intake valve seat 177. This is the only access for this operation in the field—a hard and time consuming operation. The top discharge retainer opening 279 also gives access to the pressure valve seat 177. This is also a hard and time consuming operation. The conventional discharge cover retainer 186 has an Allen wrench mating surface machined into the center through the retainer 186. This is a very time consuming process to machine this octagon shape with its sharp corners through the retainer 186. In conventional discharge retainers, the ratio of Allen wrench size to nut diameter is improper. The wrench size is too small. When the conventional discharge cover retainer is been in operation for a while and is corroded in place the retainer is loosened with a sledge hammer. The diameter of the wrench is too small and is very springy when hit with the sledge hammer and can kick back making it a dangerous operation to remove the cover.

The discharge cover 261 of the present invention is modified for the longer reach to the valve spring 173 and use with the flow control valve 179. The discharge cover 261 has seals that seal access to the valves 175 in the pressure head 116 from leaking frac fluids. The discharge cover 261 can be incorporated into the directional control valve as shown 130.

The design of the discharge retainer nut 181 of the present invention is threadedly inserted into the discharge opening 379 (see FIG. 22) and increases the ratio of wrench to retainer diameter and is much easier to machine and is much safer to use. A wrench opening 182 is machined as an octagon shape groove 182 machined in a continuous path at a depth the same as the width of the groove 182. This ratio may change due to the application. No center hole access is required because of other access locations designed into the plunger manifold 26. In the conventional designs liquids enter through the Allen wrench openings and rust the discharge retainer 186, 241 their mating discharge covers together making them very hard to remove. With the discharge retainer 181 of the present disclosure, there is no center access to the nut 181, thus, no oxidation between parts. Each segmented head 20 only uses one discharge retainer 181. No rear access is required for intake valve assembly removal and placement.

The modular design of the pressure head 116 permits the entire vertical portion, from the bottom 88 of the pressure head 116 to the top 124 of the pressure head 116 to be machined by turning the pressure head 116 on a small CNC lathe. Also the outside surface 84, 88 and 118 of the pressure head 116 would be turned in the same operation. The entire Intake head 85 is machined in a CNC lathe only going to a small milling machine for the bolt pattern and flats for different center distances. In conventional mono blocks, none of the valve bores, packing nut threads, packing bore, plunger bore, discharge nut bore in one plane and entry from the intake bore, including the bottle bores, through the entire fluid end to and including the discharge retainer threads out the top of the head can be machined in a lathe due to the large size and non-symmetrical configuration of the mono block. Not only the bores but the entire fluid end has to be machined on very expensive boring mills with very expensive attachments and tooling. Using the milling process to machine large threads, long and large bores is very slow adding to short supply which adds a lot to the cost. In the present invention all inside machining to the pressure head, intake head and including the large plunger bore of the plunger manifold can be machine with CNC lathes. Thus, all bores in the pressure head, intake head and plunger manifold of the present invention may be machined more quickly and less expensively than any conventional mono block design.

The segmented fluid end 12 of the present disclosure can be economically produced out of many longer wearing materials than conventional fluid ends. Harder materials that would offer better wear characteristics are much easier removed in a lathe than removed in a boring mill. Milling is very limited in the hardness of materials that can be machined especially in milling threads and deep bores.

The plunger manifold 26 of the present disclosure may comprise a number of different inlet and outlet configurations. For example, the angle at which fluids enter the manifold 26 can be ninety degrees or an angle less than ninety degrees. Such different angles can extend the wear life of the manifold due to easier fluid movement transition in and out of the manifold. In the preferred embodiment, the plunger manifold intake and pressure head mounting surfaces 75 are angled upward and downward, respectively, at 18 degrees with respect to the longitudinal axis of the plunger 256 but can be at any angle depending on the application, thus, offering great versatility not available by any conventional manufacture.

The plunger manifold 26 of the present disclosure can be easily removed and replaced without having to completely disassemble the segmented fluid end.

As mentioned, the plunger manifold 26 of the present disclosure is completely reversible. With this structure and arrangement, each plunger manifold intake and pressure head mounting surface 75 may be used as either the pressure side 76 or the intake side 74. During use, the pressure side 76 of the plunger manifold 26 wears faster than the intake side 74. The reversible structure of the present plunger manifold 26 permits the user after a certain period of use to turn the head 180 degrees to extend the life of the manifold 26. This ability to rotate the plunger manifold 26 can up the life of the manifold up to 75% and cannot be duplicated in any other fluid end.

In some applications, the user may find it desirable to use a smaller plunger 256 to generate more pressure or a larger plunger 256 to move a larger volume of fluid. Usually two adjacent sized plungers can be used with different sized packing nuts in each fluid end. Plunger diameters have a wide range of sizes. If the user has a full range size of plungers available to stimulate wells, the user will have several different sized fluid ends available. There are two options available. One is to have a separate fracking unit 345 (FIG. 31) available for each size fluid end, times the required amount fracking units 345 to do the fracking job, or take the time to change all fluid ends needed when a size change of plunger is required whether using the mono block, one piece segmented head or the present invention. The advantage of the present invention is that the user need only stock and change whatever size plunger manifold 26 is required and only have to stock, maintain and service the same pressure head 116 and intake head 85 for all plunger 256 sizes 5 inch diameter and smaller and stock, maintain and service the same pressure head 116 and intake head 85 for all plunger 256 sizes 5½ inch and larger. Not only does this ability of the new invention bring down cost of not requiring the expense of multiple mono block 281, one piece fluid ends 330 and complete frac units 345 but also gives all the advantages of the present invention in life, servicing, stocking and overall cost of ownership will save oil and gas operators millions in equipment and production costs.

Methods

A method of replacing a valve seat 175, valve seat 177 or valve spring 173, in a pump is provided, the method comprising the steps of: providing a segmented fluid end 12 comprising interchangeable plunger manifolds 26, intake heads 85, and pressure heads 116; selecting a head 85, 116 comprising the valve seat 175, valve seat 177 or valve spring 173; removing the selected head 85, 116; providing a replacement head 85, 116 comprising a valve seat 175, valve seat 177 and valve spring 173; replacing the selected head 85, 116 with the replacement head 85, 116.

A method of replacing an intake head 85 or pressure head 116 in a pump is provided, the method comprising the steps of: providing a segmented fluid end 12 comprising interchangeable plunger manifolds 26, intake heads 85, and pressure heads 116; selecting a head 85, 116; removing the selected head 85, 116; providing a replacement head 85, 116; replacing the selected head 85, 116 with the replacement head 85, 116.

A method of replacing a plunger manifold 26 in a pump is provided, the method comprising the steps of: providing a segmented fluid end 12 comprising one or more interchangeable plunger manifolds 26; selecting a plunger manifold 26; removing the selected plunger manifold 26; providing a replacement plunger manifold 26; replacing the plunger manifold 26 with the replacement plunger manifold 26.

CHANGES AND MODIFICATIONS

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure.

I claim:

1. A fluid end comprising a plurality of fluid end segments;

two or more of the fluid end segments each comprising a plunger manifold, an intake head, and a pressure head;

the plunger manifold comprising first and second mounting surfaces, each of said mounting surfaces comprising a fluid opening;

the intake head and pressure head each comprising a mounting flange;

the intake head mounting flange being removably coupled to the first mounting surface, the pressure head mounting flange being removably coupled to the second mounting surface;

the plunger manifold further comprising a plunger mounting member comprising a plunger opening adapted to receive a plunger;

the two or more fluid end segments further comprising first and second fluid end segments;

each of the first and second fluid end segment pressure heads comprising first and second sides; and the second side of the first fluid end segment pressure head being removably coupled to the first side of the second fluid end segment pressure head, such that the first and second fluid end segments are in fluid communication with one another.

2. The fluid end of claim 1, wherein the two or more fluid end segments comprise a third fluid end segment;

the third fluid end segment pressure head comprising first and second sides; and the first side of the third fluid end segment pressure head being removably coupled to the second side of the second fluid end segment pressure head, such that the second and third fluid end segments are in fluid communication with one another.

3. The fluid end of claim 2, further comprising a coupling member, the coupling member comprising an elongated bar adapted to be coupled to external surfaces of each of the first, second, and third fluid end segment plunger manifolds such that a first end of the coupling member is coupled to the first fluid end segment manifold, a second end of the coupling member is coupled to the third fluid end segment plunger manifold, and a mid-portion of the coupling member is coupled to the second fluid end segment plunger manifold.

4. The fluid end of claim 2, wherein the first, second, and third fluid end segment pressure heads are each symmetrical, such that the first side of the first fluid end segment pressure head is adapted for cooperative coupling to either the first side or second side of the second and third fluid end segment pressure heads.

5. The fluid end of claim 4, wherein forward and rearward sides of each of the first, second, and third pressure heads comprise a recessed area comprising through openings adapted to receive a fastener.

6. The fluid end of claim 2, wherein the plunger manifold is symmetrical, such that the intake head mounting flange is adapted to be removably coupled to the second mounting surface and the pressure head mounting flange is adapted to be removably coupled to the first mounting surface.

7. The fluid end of claim 2, wherein the plunger manifold mounting surfaces angle rearward towards a central longitudinal axis of the plunger manifold.

8. The fluid end of claim 2, wherein the two or more fluid end segments comprise fourth and fifth fluid end segments;

the fourth fluid end segment pressure head comprising first and second sides;

the fifth fluid end segment pressure head comprising first and second sides;

the first side of the fourth fluid end segment pressure head being coupled to the second side of the third fluid end segment pressure head;

the second side of the fourth fluid end segment pressure head being coupled to the first side of the fifth fluid end segment pressure head; and wherein, when the second side of the fourth fluid end segment pressure head is coupled to the first side of the fifth fluid end segment pressure head, the fourth and fifth fluid end segments are in fluid communication with one another.

9. The fluid end of claim 1, further comprising:

a packing nut and a packing nut pawl;

the packing nut pawl comprising first and second ends, the first end being pivotally coupled to the plunger mounting member;

the packing nut comprising a ringed configuration and threading, the threading being adapted to engage cooperative threading of the plunger opening;

the packing nut further comprising an outer circumference comprising teeth, the teeth being adapted for cooperative engagement with an end of the packing nut pawl;

the packing nut pawl second end being biased towards an engaged position with the teeth.

10. The fluid end of claim 1, the plunger mounting member comprising a plurality of stay rod openings adapted to receive stay rods.

11. The fluid end of claim 1, further comprising:

a discharge retainer nut comprising a cylindrical configuration and first and second ends;

the discharge retainer nut first end being adapted to be inserted within a fluid end retainer opening;

the discharge retainer nut second end comprising a recessed groove; and the groove comprising a polygonal shaped outside perimeter and a polygonal shaped inside perimeter.

12. The fluid end of claim 2, wherein the first and second pressure head sides of the first, second, and third fluid ends each comprise a pressure fluid opening comprising a recessed shelf adapted to receive a seal ring, the seal ring, when inserted within said pressure fluid opening, being flush with an outer surface of the respective side.

13. A method of replacing a pressure head in a segmented fluid end is provided, the method comprising the steps of:

providing a segmented fluid end comprising a plurality of fluid end segments, the fluid end segments each comprising a plunger manifold, and a pressure head, the pressure head being removably coupled to the plunger manifold;

selecting a pressure head from a selected fluid end segment;

uncoupling the selected pressure head from one or more adjacent pressure heads;

uncoupling the selected pressure head from the plunger manifold of the selected fluid end segment;

removing the selected pressure head;

providing a replacement pressure head;

coupling the replacement pressure head to the one or more adjacent pressure heads; and coupling the replacement pressure head to the plunger manifold of the selected fluid end segment.

14. A method of replacing an intake head in a segmented fluid end is provided, the method comprising the steps of:

providing a segmented fluid end comprising a plurality of fluid end segments, the fluid end segments each comprising a plunger manifold and an intake head, the intake head being removably coupled to the plunger manifold;

selecting an intake head from a selected fluid end segment;

uncoupling the selected intake head from the plunger manifold of the selected fluid end segment;

removing the selected intake head;

providing a replacement intake head; and coupling the replacement intake head to the plunger manifold of the selected fluid end segment.

15. A method of replacing a plunger manifold in a segmented fluid end is provided, the method comprising the steps of:

providing a segmented fluid end comprising a plurality of fluid end segments, the fluid end segments each comprising a plunger manifold, a pressure head, and an intake head, the pressure and intake heads being removably coupled to the plunger manifold;

selecting a plunger manifold from a selected fluid end segment;

uncoupling the selected plunger manifold from the intake head and pressure head of the selected fluid end segment;

removing the selected plunger manifold from the selected fluid end segment;

providing a replacement plunger manifold; and coupling the intake head and pressure head of the selected fluid end segment to the replacement plunger manifold.

16. A method of repairing a segmented fluid end is provided, the method comprising the steps of:

providing a segmented fluid end comprising a plurality of fluid end segments, the fluid end segments each comprising a plunger manifold, an intake head, and a pressure head, the intake and pressure heads being removably coupled to the plunger manifold;

selecting a fluid end segment;

uncoupling the pressure head of the selected fluid end segment from one or more adjacent pressure heads;

uncoupling the plunger manifold of the selected fluid end segment from one or more coupling members, said one or more coupling members spanning from the selected fluid end segment to an adjacent fluid end segment; and removing the selected fluid end segment.

17. The method of claim 16 further comprising the steps of:

providing a replacement fluid end segment, the replacement fluid end segment comprising a replacement plunger manifold, a replacement intake head, and a replacement pressure head, the replacement intake head and replacement pressure head each being removably coupled to the replacement plunger manifold;

coupling the replacement pressure head to the one or more adjacent pressure heads; and coupling the replacement plunger manifold to the one or more coupling members.

18. The method of claim 17 further comprising the steps of:

coupling the replacement plunger manifold to one or more adjacent plunger manifolds.

19. A fluid end comprising a plurality of fluid end segments;

three or more of the fluid end segments each comprising a plunger manifold, an intake head, and a pressure head;

the plunger manifold comprising first and second mounting surfaces, each of said mounting surfaces comprising a fluid opening;

the intake head and pressure head each comprising a mounting flange;

the intake head mounting flange being removably coupled to the first mounting surface, the pressure head mounting flange being removably coupled to the second mounting surface;

the plunger manifold being symmetrical, such that the intake head mounting flange is adapted to be removably coupled to the second mounting surface and the pressure head mounting flange is adapted to be removably coupled to the first mounting surface;

the plunger manifold further comprising a plunger mounting member comprising a plunger opening adapted to receive a plunger;

the three or more fluid end segments further comprising first, second, and third fluid end segments;

each of the first, second, and third fluid end segment pressure heads comprising first and second sides;

the second side of the first fluid end segment pressure head being removably coupled to the first side of the second fluid end segment pressure head, such that the first and second fluid end segments are in fluid communication with one another;

the first side of the third fluid end segment pressure head being removably coupled to the second side of the second fluid end segment pressure head, such that the second and third fluid end segments are in fluid communication with one another;

the fluid end further comprising a coupling member, the coupling member comprising an elongated bar adapted to be coupled to external surfaces of each of the first, second, and third fluid end segment plunger manifolds such that a first end of the coupling member is coupled to the first fluid end segment manifold, a second end of the coupling member is coupled to the third fluid end segment plunger manifold, and a mid-portion of the coupling member is coupled to the second fluid end segment plunger manifold;

the first, second, and third fluid end segment pressure heads each being symmetrical, such that the first side of the first fluid end segment pressure head is adapted for cooperative coupling to either the first side or second side of the second and third fluid end segment pressure heads;

the first, second, and third pressure heads each comprising forward and rearward sides, each forward and rearward side comprising a recessed area comprising through openings adapted to receive a fastener; and the first and second pressure head sides of the first, second, and third fluid ends each comprising a pressure fluid opening comprising a recessed shelf adapted to receive a seal ring, the seal ring, when inserted within said pressure fluid opening, being flush with an outer surface of the respective side.

20. The fluid end of claim 19, wherein the plunger manifold mounting surfaces angle rearward towards a central longitudinal axis of the plunger manifold.

* * * * *